US007926977B2

(12) United States Patent
Nall et al.

(10) Patent No.: US 7,926,977 B2
(45) Date of Patent: Apr. 19, 2011

(54) LED LIGHTING SYSTEM FOR A CABINET SIGN

(75) Inventors: Jeffrey M. Nall, Brecksville, OH (US); Koushik Saha, Brunswick, OH (US); Xin Wang, Shanghai (CN); Kevin Carpenter, Shaker Heights, OH (US); Douglas R. Halley, Westlake, OH (US); John Owens, Olmsted Falls, OH (US)

(73) Assignee: GE Lighting Solutions, LLC, Cleveland, OH (US)

( * ) Notice: Subject to any disclaimer, the term of this patent is extended or adjusted under 35 U.S.C. 154(b) by 260 days.

(21) Appl. No.: 12/212,136

(22) Filed: Sep. 17, 2008

(65) Prior Publication Data

US 2009/0073693 A1 Mar. 19, 2009

Related U.S. Application Data

(60) Provisional application No. 60/973,009, filed on Sep. 17, 2007, provisional application No. 61/015,927, filed on Dec. 21, 2007.

(51) Int. Cl.
*F21S 4/00* (2006.01)

(52) U.S. Cl. ..... 362/249.02; 362/249.06; 362/249.11

(58) Field of Classification Search ..... 362/240, 362/249.01, 249.02, 249.06, 249.04, 249.11, 362/812; 40/544, 572
See application file for complete search history.

(56) References Cited

U.S. PATENT DOCUMENTS

| | | | | |
|---|---|---|---|---|
| 5,363,282 | A | 11/1994 | Hirokazu | |
| 5,404,282 | A | 4/1995 | Klinke et al. | |
| 6,099,933 | A * | 8/2000 | Lamparter | 428/99 |
| 6,170,963 | B1 | 1/2001 | Arnold | |
| 6,241,373 | B1 * | 6/2001 | Kelley et al. | 362/545 |
| 6,483,439 | B1 * | 11/2002 | Vukosic | 340/815.65 |
| 6,761,471 | B2 | 7/2004 | Wu | |
| 6,853,151 | B2 | 2/2005 | Leong et al. | |
| 6,932,495 | B2 * | 8/2005 | Sloan et al. | 362/294 |
| 7,114,831 | B2 | 10/2006 | Popovich et al. | |
| 7,329,024 | B2 * | 2/2008 | Lynch et al. | 362/240 |
| 7,377,669 | B2 * | 5/2008 | Farmer et al. | 362/249.01 |
| 7,648,254 | B2 * | 1/2010 | Yoo et al. | 362/249.01 |
| 2002/0126064 | A1 | 9/2002 | Yen | |
| 2005/0007033 | A1 | 1/2005 | Kan et al. | |

FOREIGN PATENT DOCUMENTS

| | | |
|---|---|---|
| ES | 2 261 018 | 11/2006 |
| WO | WO 03/004930 | 1/2003 |

OTHER PUBLICATIONS

U.S. Appl. No. 11/784,639, filed Apr. 9, 2007.
PCT Search Report from PCT/US2008/076522, Sep. 16, 2008.

* cited by examiner

*Primary Examiner* — John A Ward
(74) *Attorney, Agent, or Firm* — Fay Sharpe LLP

(57) ABSTRACT

A lighting system generally includes a plurality of electrically interconnected modules. Each module includes a support, circuitry on the support, at least two light emitting diodes ("LEDs") on the support and electrically connected to the circuitry, and a housing over the support for covering the circuitry. A first LED on a first surface of the support emits light in a first general direction and a second LED mounted on a second surface of the support emits light in a second general direction, which is opposite the first general direction.

22 Claims, 24 Drawing Sheets

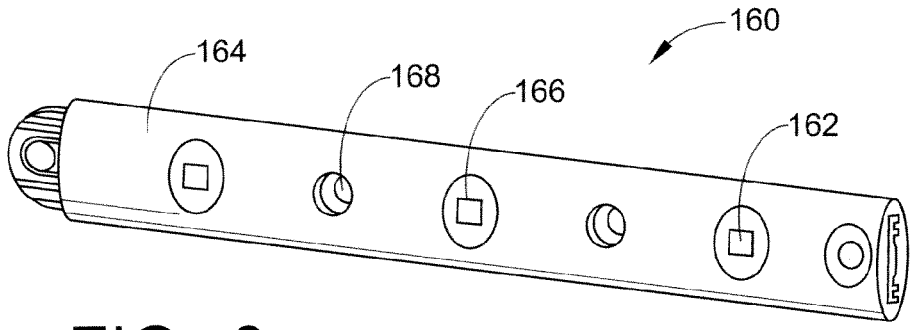
FIG. .8
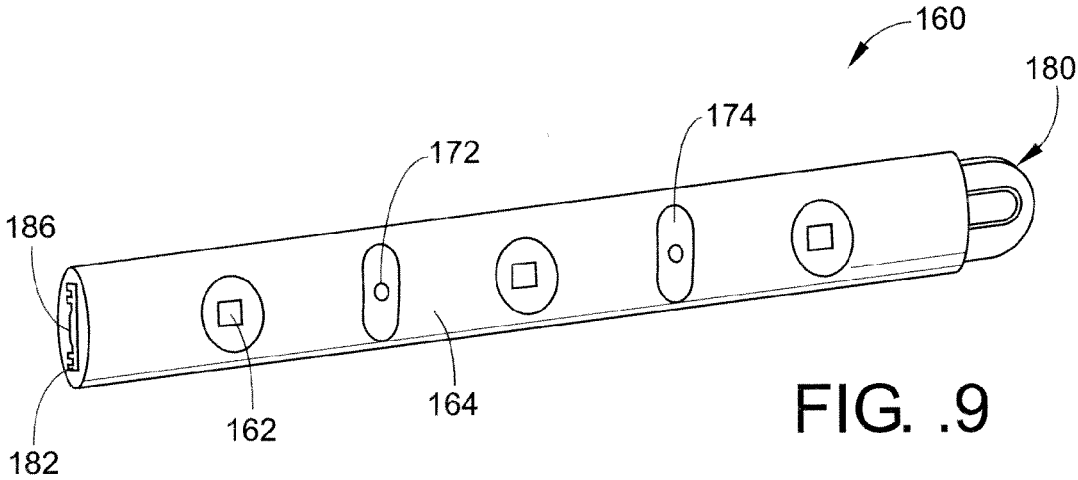
FIG. .9
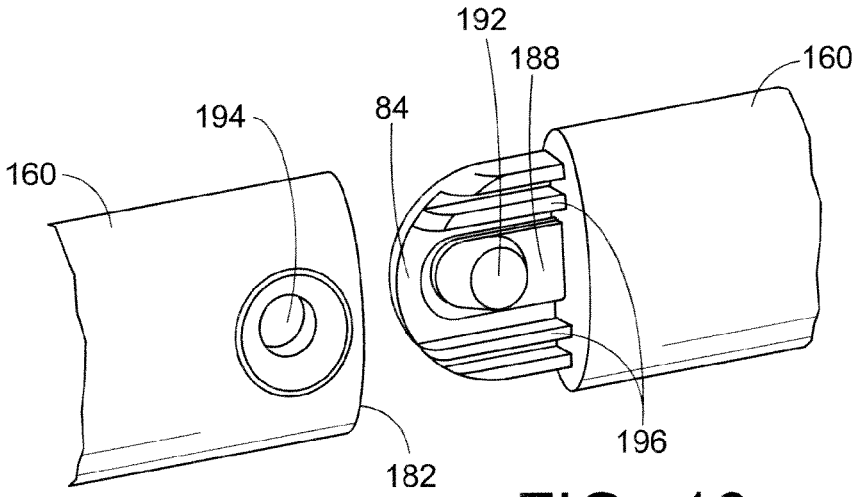
FIG. .10

LED LIGHTING SYSTEM FOR A CABINET SIGN

This application claims the benefit of Application Ser. No. 60/973,009 filed Sep. 17, 2007 and Application Ser. No. 61/015,927 filed Dec. 21, 2007, which are hereby incorporated by reference in their entirety.

BACKGROUND

Large cabinet signs, which can also be referred to as box signs, typically use fluorescent bulbs and a ballast as the lighting system. As seen in FIG. 1, a sign housing 12 and translucent panels 14 define a hollow enclosure and fluorescent tubes 16 and a ballast (not shown) mount inside the enclosure. The fluorescent tubes 16 illuminate both the front panel and the rear panel, but fluorescent tube lighting has its drawbacks.

Fluorescent tubes emit light in a 360 degree pattern from a central axis. Light that is emitted from the top and bottom portions of the tube is generally wasted and does not reflect well toward the translucent panels. This decreases the efficiency of the system.

The typical life for the lighting system of box signs illuminated using fluorescent lamps is about 12,000 hours, which is measured as when fifty percent of the lamps have burned out. It would be desirable to increase the lifetime of the lighting system that is used to illuminate the box sign.

High intensity discharge (HID) lamp fixtures have also been used in large signs. The HID lamps typically include lenses that are placed over the individual fixtures to preferentially spread light across the backside of each panel. High intensity discharge lamps, however, are susceptible to unintended dimming at low temperatures. Similarly, fluorescent lamps lose efficiency and efficacy at lower temperatures.

SUMMARY

A lighting system for illuminating cabinet signs, which can also be referred to as box signs, that uniformly illuminates the translucent panels of the cabinet sign and provides an increased life and robustness not found in the known fluorescent and HID lamp systems is described. This lighting system generally includes a plurality of electrically interconnected modules. Each module includes a support, circuitry on the support, at least two light emitting diodes ("LEDs") on the support and electrically connected to the circuitry, and a housing over the support for covering the circuitry. A first LED on a first surface of the at least one support emits light in a first general direction and a second LED mounted on a second surface of the at least one support emits light in a second general direction, which is opposite the first general direction.

BRIEF DESCRIPTION OF THE DRAWINGS

FIG. 8 is a front perspective view of an LED module of a lighting system for illuminating a box sign.

FIG. 9 is a rear perspective view of the LED module depicted in FIG. 8.

FIG. 10 is a perspective view of the ends of two LED modules prior to one module connecting to the other.

DETAILED DESCRIPTION

Figure 2:
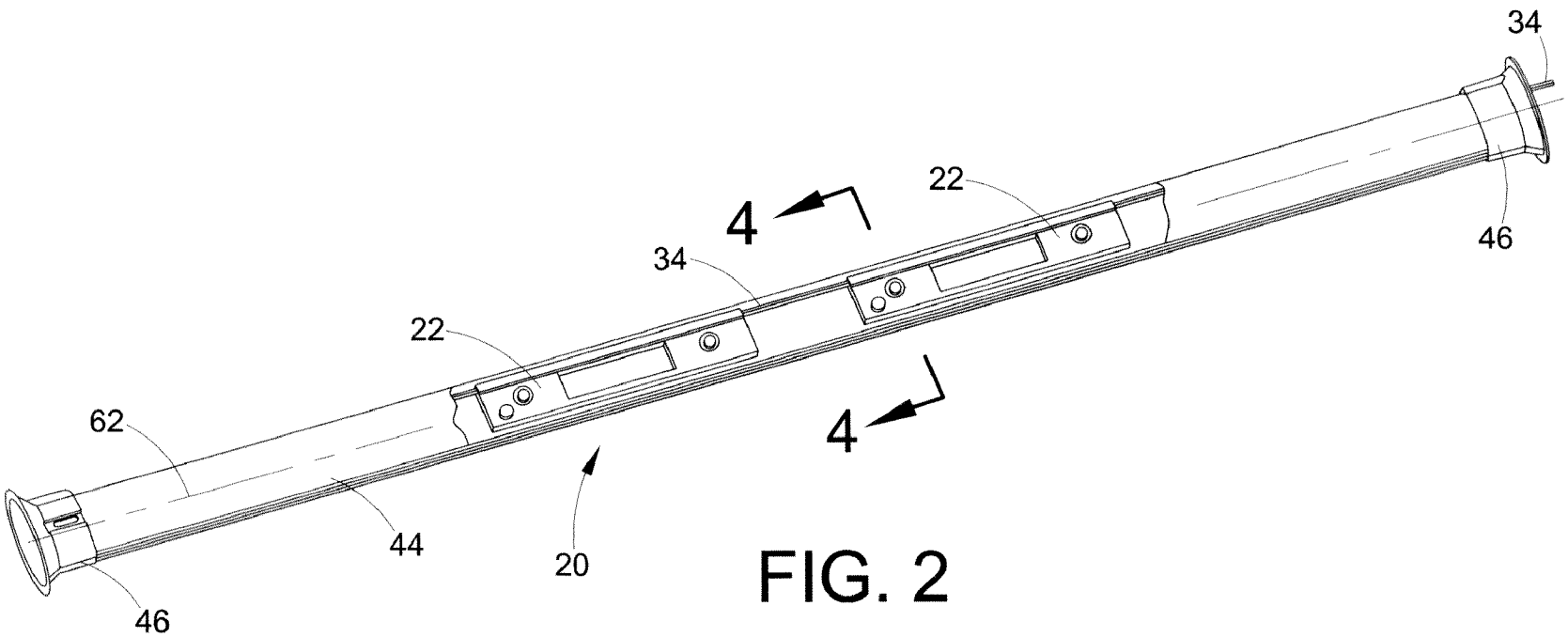
FIG. 2 is perspective view, partially broken away of a lighting system that can be used to light the sign shown in FIG. 1.

With reference to FIG. 2, an LED lighting system 20 is shown that can illuminate the cabinet sign 10 shown in FIG.

Figure 1:
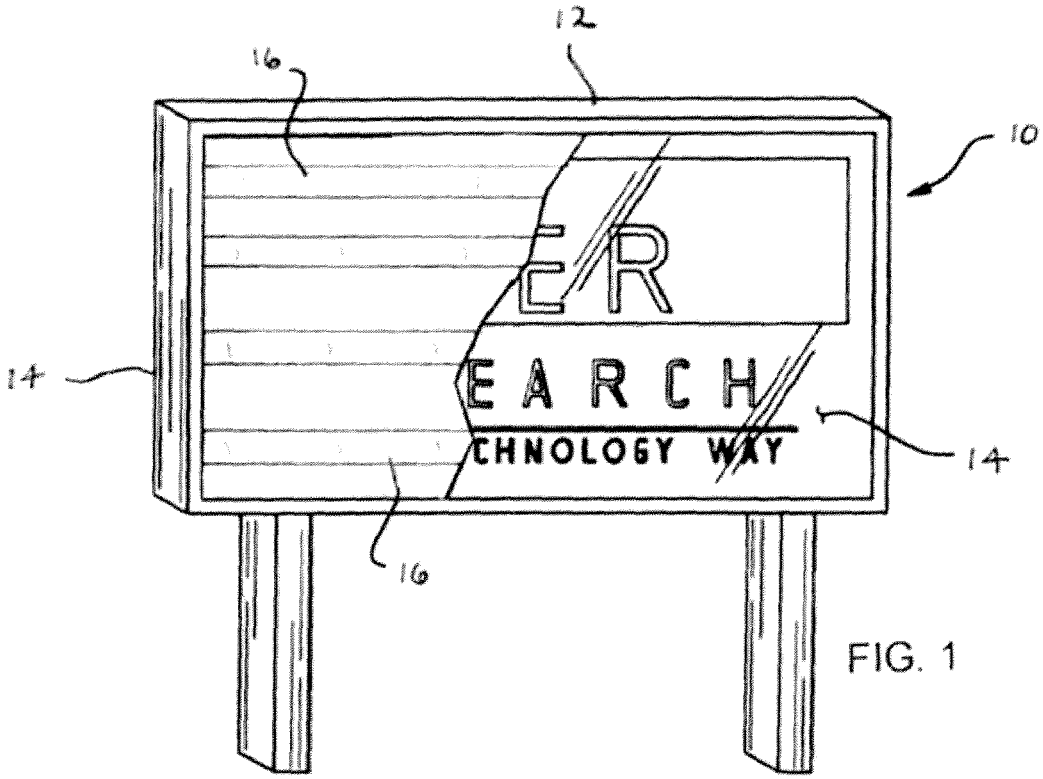
FIG. 1 Prior Art
FIG. 1 is a perspective view of a known box sign with a portion of a translucent panel broken away to show internal components within the sign.
Figure 3:
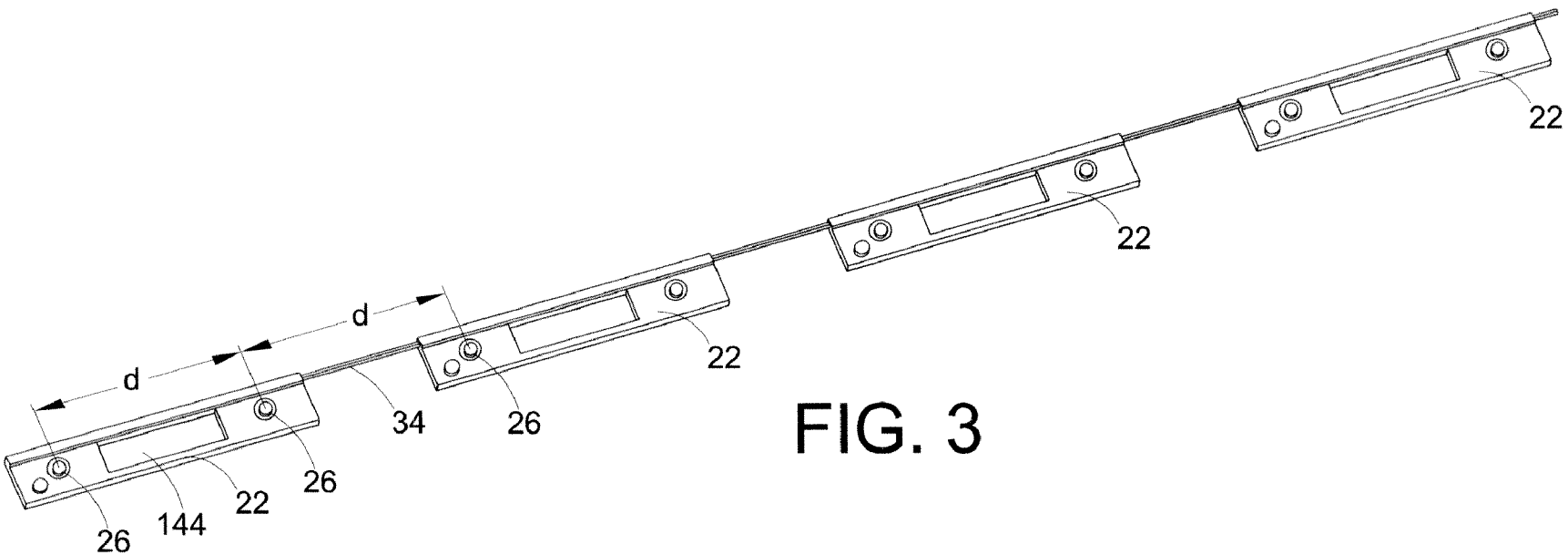
FIG. 3 is a perspective view of LED modules for the lighting system shown in FIG. 2.
Figure 4A:
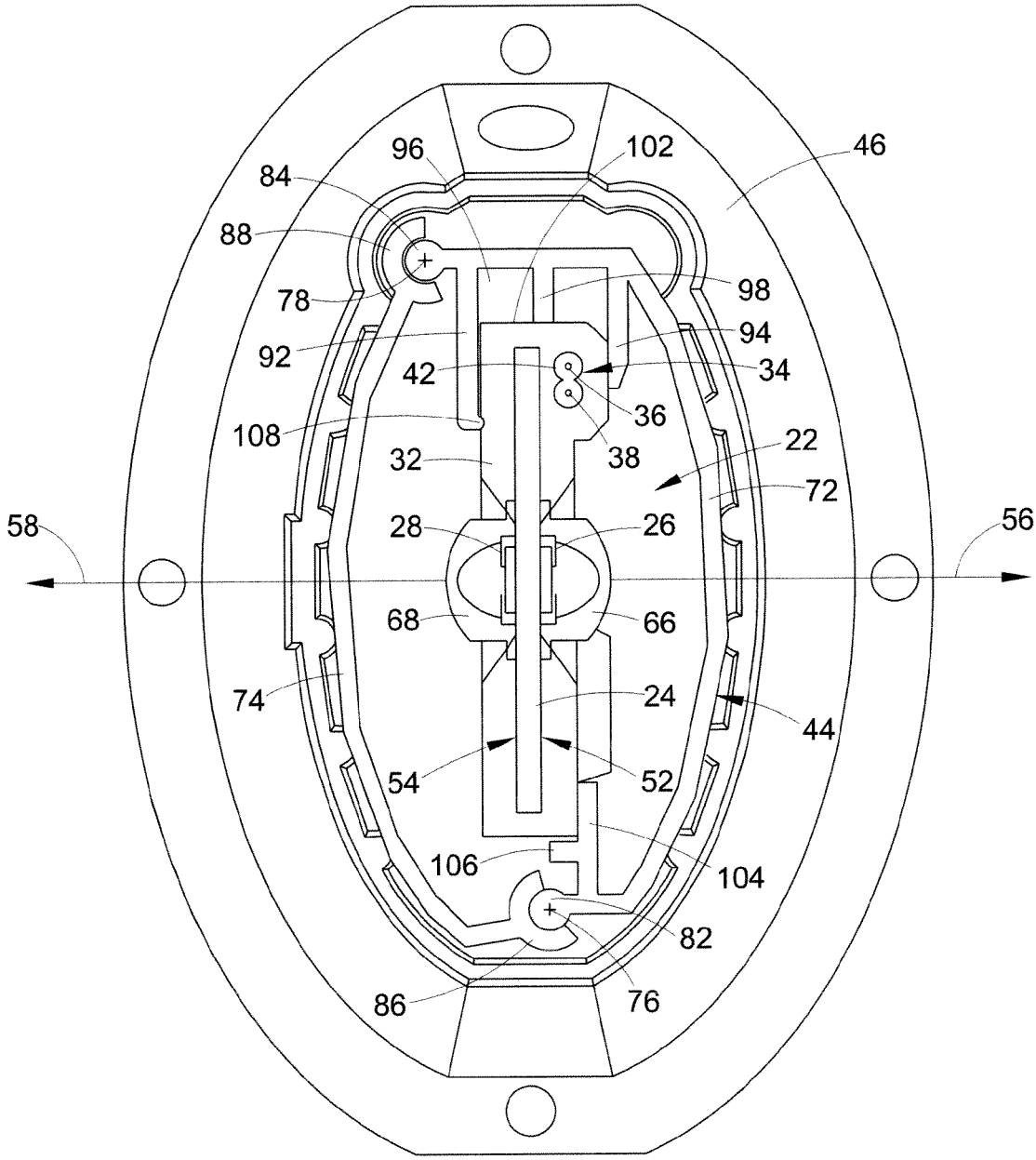
FIGS. 4A and 4B are view taken along line 4-4 in FIG. 2.
Figure 4B:
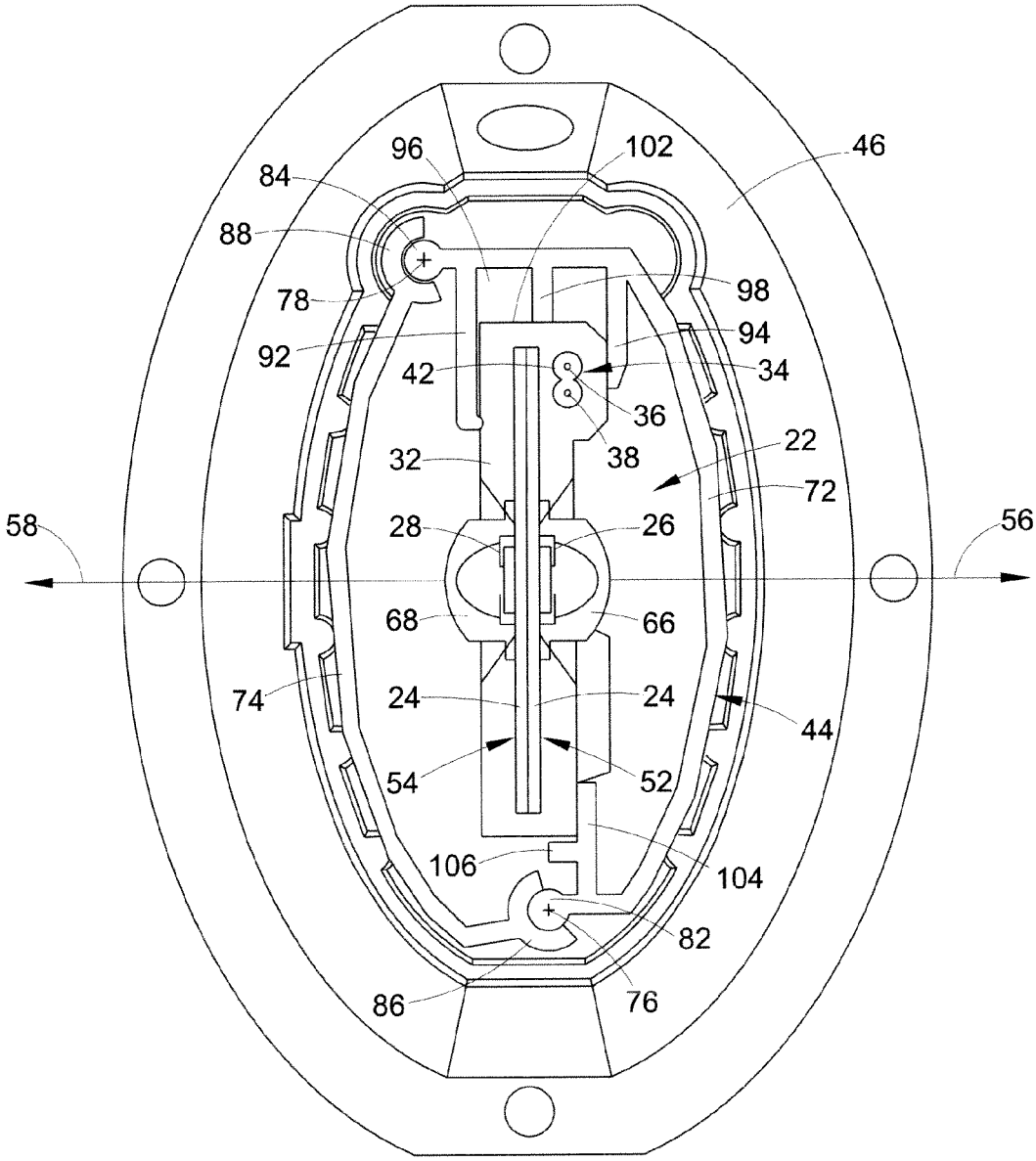

1. The lighting system 20 can mount to in housing 12 of the cabinet sign 10 to illuminate both the front panel and the rear panel of the sign. The lighting system 20 includes a plurality of electrically interconnected modules 22 (see also FIG. 3). With reference to FIGS. 4A and 4B, each module includes a support 24 (a one piece support is shown in FIG. 4A and a two piece support is shown in FIG. 4B), circuitry (not visible) on the at least one support, at least two opposing LEDs 26 and 28 on respective sides of the support and electrically connected to the circuitry, and a housing 32 over the support for covering the circuitry. For brevity, the embodiment depicted in FIG. 4A will be described in detail and where differences between FIGS. 4A and 4B are relevant, these will be discussed. The lighting system 20 also includes at least one flexible electrical conductor 34 electrically connecting the modules 22. As seen in FIG. 4, the flexible (or rigid) electrical conductor 34 includes a first wire 36 and a second wire 38 that are electrically isolated from one another by an insulated covering 42. With reference back to FIG. 2, the lighting system also includes a rigid spine, which in the embodiment shown in FIG. 2 is a tubular member 44, connected with the modules 22. The spine 44 is more rigid than the flexible electrical conductor 34 which facilitates fixing the modules in relation to one another. End caps 46 connect with the tubular member 44 at each end of the tubular member and are configured for connection with the sign housing 12 (FIG. 1).

With reference to FIG. 4A, the support 24 is a double-sided printed circuit board ("PCB"). FIG. 4B depicts the support 24 as two single-sided PCBs placed back-to-back with each other. In FIG. 4A, the support 24 is a double-sided FR4 PCB having copper traces formed on a first surface 52 and a second surface 54, which are parallel to one another. The copper traces (not visible) are large to act as a heat sink for the LEDs 26 and 28 to dissipate the heat generated by the LEDs. First LED 26, or LEDs (see FIGS. 2 and 3), mount on the first surface 52 and emit light in a first general direction designated by arrow 56. Second LED 28, or LEDs (see FIGS. 2 and 3) mount to the second surface 54 and emits light in a second general direction 58, which is opposite the first general direction. The first LEDs 26 illuminate a first (front) panel of the cabinet sign 10 and the second LEDs 28 illuminate the second (rear), or opposite, panel of the cabinet sign 10. With reference to FIG. 3, the first LEDs 26 (as well as the second LEDs 28) are spaced a distance d (center-to-center) from one another on each module 22. Additionally, when the flexible electrical conductor 34 is pulled substantially taut, the distance between the first LED 26 (and the second LED 28) of one LED module 22 and the first LED 26 of an adjacent LED module 22 is also a distance d (center-to-center). Accordingly, the LEDs that illuminate the front (or rear) panel of the box sign 10 are evenly spaced from one another in a direction parallel to a longitudinal axis 62 (FIG. 2) of the lighting system.

With reference back to FIG. 4A, each LED includes a beam spreading optic associated with a respective LED for spreading the light emitted by the LED with respect to an axis that is normal to the LED. For example, a first refractive optic 66 mounts over the first LED 26 and a second refractive optic 68 mounts over the second LED 28. The optics 66 and 68 spread the light from the respective LEDs 26 and 28 away from the respective axes 56 and 58 shown in FIG. 4A. More detail on this is provided below. Furthermore, other optics, for example reflective optics, can also be used to spread the light from the respective LEDs.

The housing 32 in the depicted embodiment is an overmolded housing that protects the circuitry on the PCB. The overmolded housing can be made from a thermally conductive plastic, which can aid in heat dissipation. As seen in FIG. 4A, the overmolded housing 32 also encloses the flexible electrical conductor 34 where it resides over the PCB 24. Alternative housing arrangements could be provided such as a claim-shell housing.

With continued reference to FIG. 4A, the tubular member 44 includes a first section 72 detachable from a second section 74 to provide access to the modules 22. The tubular member 44 is shown as generally elliptical in cross section, but the tubular member can take other configurations in cross section, e.g. circular or square. In the depicted embodiment, the first section 72 of the tubular member 44 pivots away from the second section 74 about an axis 76 or an axis 78 which are both substantially parallel to a longest dimension of the tubular member 44 and substantially parallel to the longitudinal axis 62 (FIG. 2). In the depicted embodiment, the first section 72 includes a first cylindrical terminal portion 82 substantially centered with the axis 76 and a second cylindrical terminal portion 84 substantially centered with the axis 78. The first cylindrical terminal portion 82 is received in a first C-shaped socket 86 formed at one end of the second section 74 and the second cylindrical terminal portion 84 is received in a second C-shaped socket 88 formed at a second, opposite, end of the second section 74. These cylindrical sections 82 and 84 snap into the respective sockets 86 and 88 to connect the first section 72 to the second section 74. The first section 72 can pivot with respect to the second section 74 about either axis 76 and 78 when the opposite C-shaped socket is disengaged from the respective cylindrical terminal portion.

The spine, which in the embodiment depicted in FIG. 4A is the tubular member 44, also include projections 92 and 94 that define a channel 96 into which the modules 22 are received. A central projection 98 is disposed between the outer projections 92 and 94 that define the channel 96. Detents 102 formed on the housing 32 of each LED module 22 contact the central projection 98 to align the LED modules 22 with respect to the tubular member 44 so that the LEDs 26 and 28 illuminate in opposite directions. The first section 72 of the tubular member 44 also includes a lower projection 104 (per the orientation shown in FIG. 4A) having an integrally formed flange 106 that also engages the respective housings 32 of the LED modules 22 to align the LED modules within the tubular member 44 and to connect the LED modules with tubular member. Projection 92 also includes a distal protuberance 108 that extends toward the module so that the projection 92 flexes to create an interference fit for the module 22 between the projections 92 and 94.

The tubular member 44 can be made from a transparent or translucent material. Accordingly, the tubular member 44 can at least include a translucent section for allowing light from the LEDs to escape from the tubular member. The tubular member can also include slots or openings 110 aligned with the LEDs to allow light to escape without having to pass through the tubular member 44. The openings 110 avoid light loss that occurs when light travels through the tubular member. The translucent section(s) and/or openings (only one shown in FIG. 2) would be in the area of the tubular member intersected by the axes 56 and 58, which allows direct (non-reflected) light from each LED 26 and 28 to escape the tubular member. The tubular member 44 can further disperse the light that emanates from the respective LEDs 26 and 28. For example, the translucent sections can be made from a material that can diffuse the light or the translucent sections can be made to have lensing properties.

Figure 5:
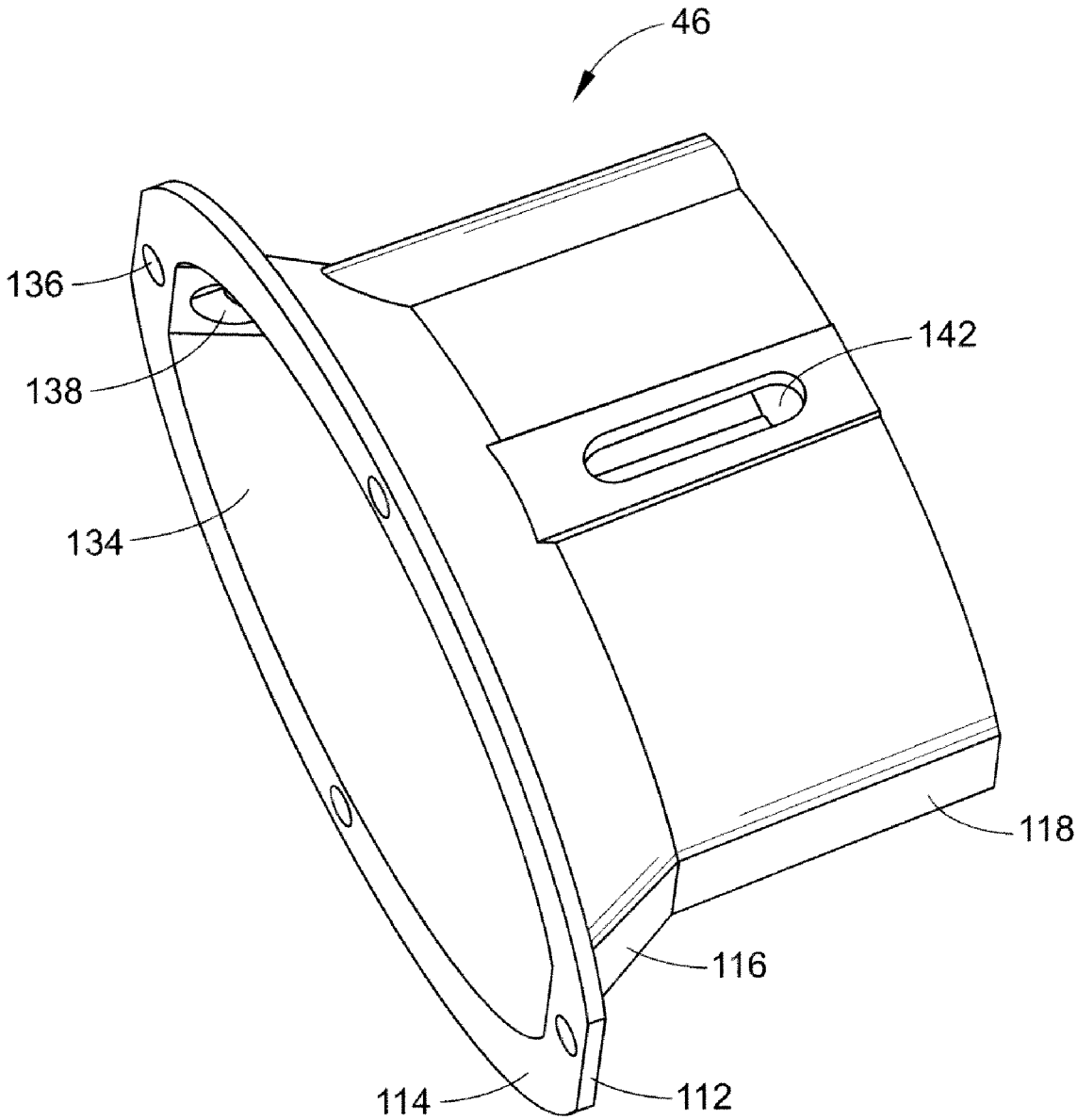
FIG. 5 is a lower perspective view of an end cap for the lighting system shown in FIG. 2.
Figure 6:
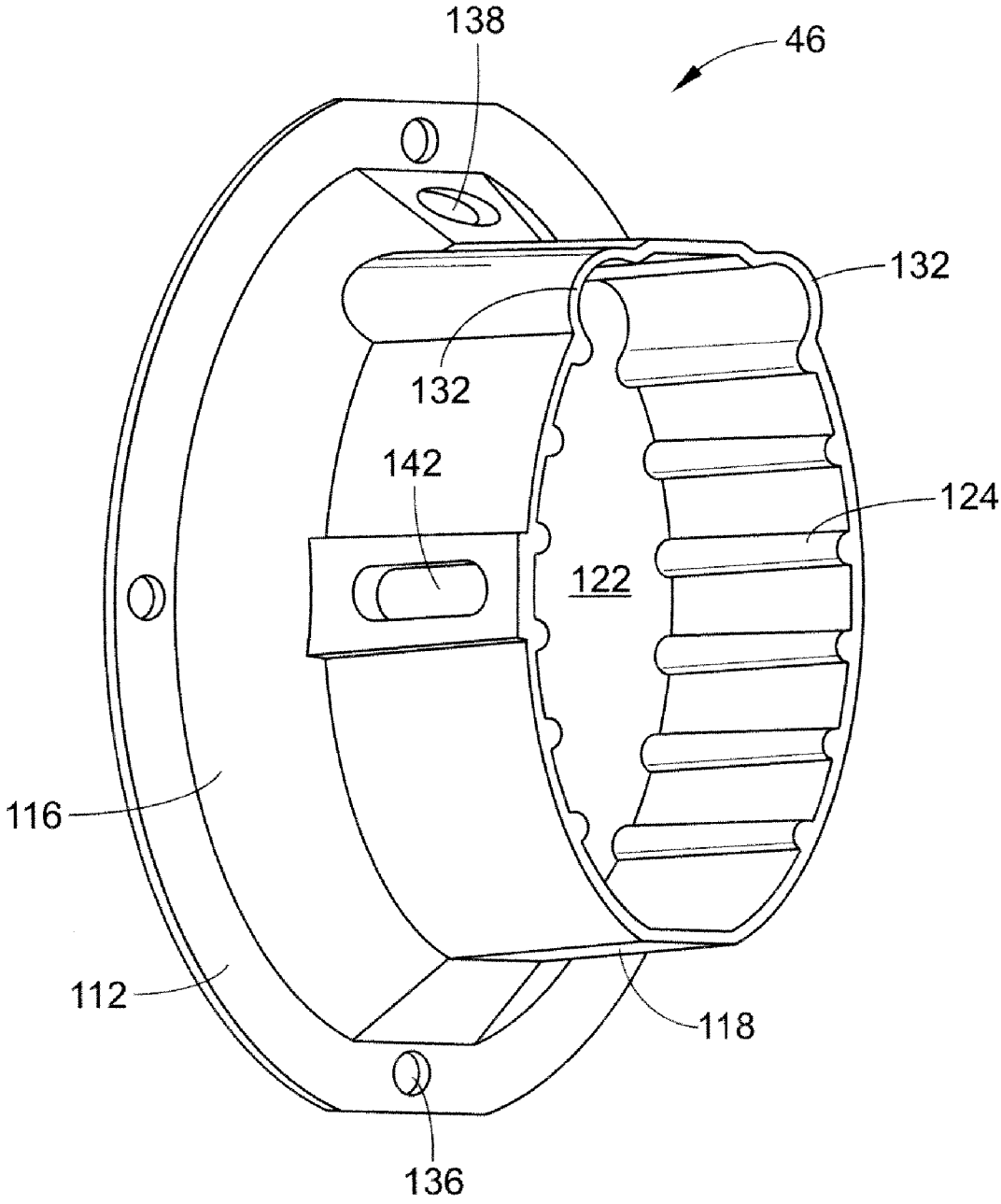
FIG. 6 is an upper perspective view of the end cap shown in FIG. 5.

As more clearly seen in FIG. 5, the end cap 46 includes a base 112 having a planar mounting surface 114. A tapered section 116 extends away from the base and a generally elliptical section 118 extends away from the tapered section 116. With reference to FIG. 6, the elliptical section 118 of the end cap 46 defines a recess 122. The recess 122 receives the tubular member 44. In a cross section taken normal to the longitudinal axis 62 (FIG. 2) of the lighting system 20, the recess 122 is non-circular in configuration and is similar in cross-sectional configuration to the tubular member 44. Elongate protrusions 124 extend inwardly into the recess 122 from the generally elliptical section 118 to engage the tubular member 44 and create an interference fit. The configuration of the recess 122 and generally elliptical section 118 is chosen to match the cross-sectional configuration of the tubular member 44 that it receives. The shape of the elliptical section 118 can change if the shape of the tubular member is changed.

Figure 7:
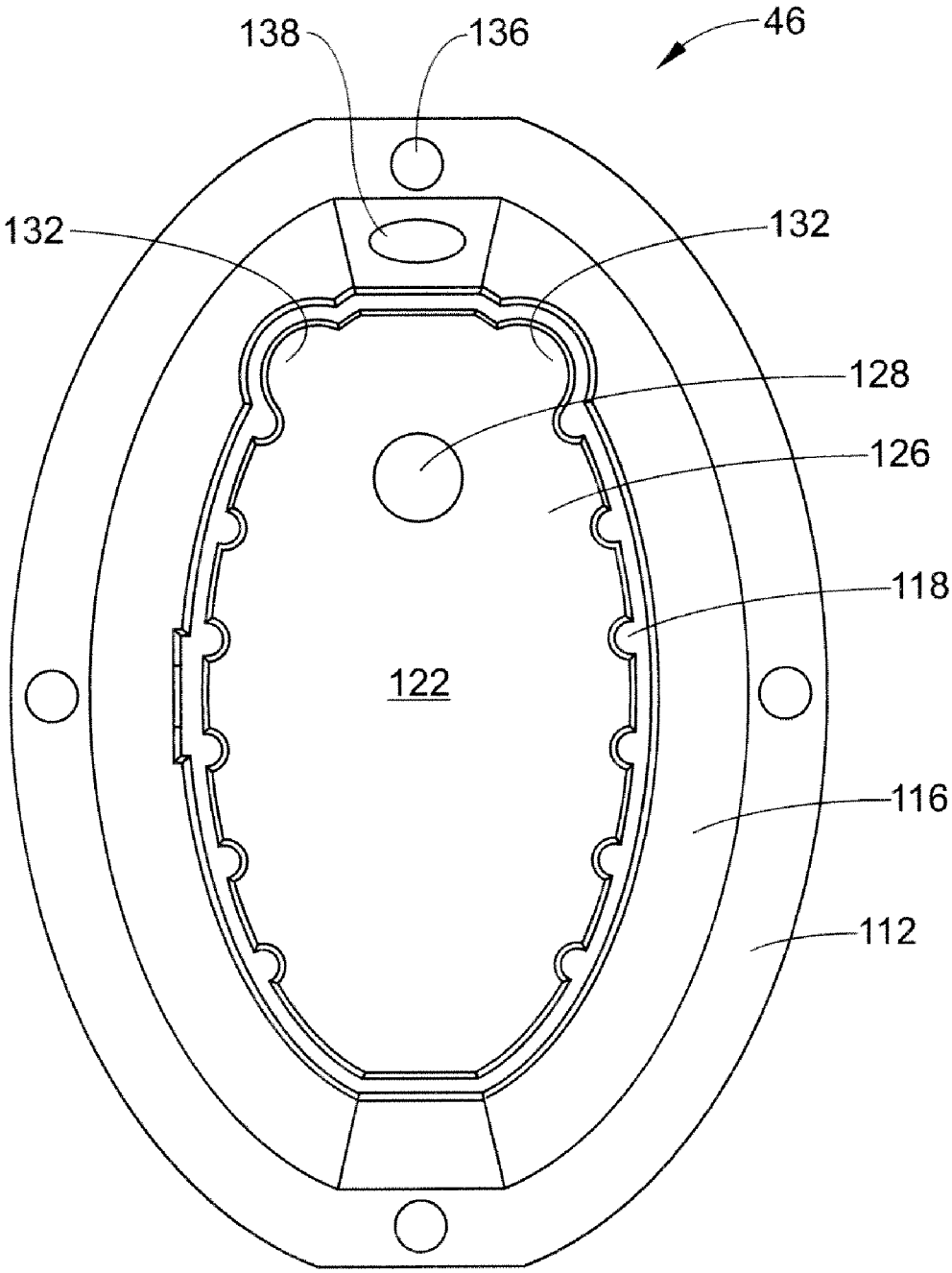
FIG. 7 is a top plan view of the end cap shown in FIG. 5.

With reference to FIG. 7, a base wall 126 defines a lower surface of the recess 122 and includes an opening 128 through which the flexible electrical conductor 34 (FIG. 2) can pass. The generally elliptical section 118 is shaped to define pockets 132 that are configured to receive the C-shaped sockets 86 or 88 of the second section 74 of the tubular member 44 (see FIG. 4A). This provides another indexing feature for the lighting system 20 to align the LEDs 26 and 28 so that they illuminate opposite facing panels in a box sign. Two pockets 132 are provided so that the end caps 46 can be placed on either end of the tubular member 44. The bas wall 126 also separates the recess 122 from a cavity 134 (FIG. 5) defined by the base 114 and the tapered section 116. The cavity 134 is large enough to cover a conventional fluorescent lamp socket that is mounted to the internal sides of the sign housing 12.

The end cap 46 provides a connector for connecting the lighting system 20 to the cabinet sign housing 12. In a retrofit installation the end cap 46 can be placed over a conventional fluorescent lamp socket to cover the fluorescent lamp socket. The mounting surface 114 is planar to attach nicely to the housing 12 and fastener openings 136 are provided through the base 112 for attaching the end cap 46 to the sign housing. An opening 138 is provided in the tapered section 116 near the opening 128 through the intermediate wall 126 to allow the flexible electrical conductor 34 to pass through this opening 138 for making an electrical connection. A slotted opening 142 is provided in the generally elliptical section 118. The slotted opening 142 has a major axis that is parallel to the longitudinal axis 62 of the lighting system 20 (see FIG. 2). This allows for adjustment of the tubular member 44 within the recess 122 to accommodate for tolerances within the sign housing. Typically the tubular member is about eight feet in length and sign housings are typically about eight feet in length. Other lengths of a tubular member can be provided. The slotted opening 142 receives a fastener for connecting the end cap 46 to the tubular member 44. By being slotted having a major axis parallel to the longitudinal axis 62 of the lighting system 20, the slotted opening 142 allows for the tubular member 44 to move within the recess 122 parallel to the longitudinal axis prior to fastening the tubular member to the end cap 46 by inserting a fastener into the slotted opening 142.

Instead of providing the slotted opening, the intermediate wall 126 that separates the recess 122 that receives the tubular member 44 from the cavity 134 then sets overtop the fluorescent socket, the intermediate wall can be biased or spring loaded so that it can move when the tubular member is inserted into the recess and then press the tubular member 44 against the opposite end cap 46 when the lighting system is installed into the cabinet sign.

The lighting system 20 depicted in FIGS. 1-7 is cuttable. In other words, adjacent LED modules 22 are connected in parallel so that the length of the modules can be cut to fit into signs that are smaller than eight feet in length or height. In the depicted embodiment, the LED lighting system 20 has a cuttable resolution of one foot.

The tubular member 44 provides the general look of a fluorescent tube. Typically, fluorescent tubes used to illuminate cabinet signs are eight foot in length. The lighting system depicted in FIG. 2 can be inserted into a sign having fluorescent lamps with an eight foot length by placing the end caps 46 over the conventional fluorescent tube sockets and inserting the tubular members into the end caps that cover the fluorescent socket and then running the flexible electrical conductor 34 to a power supply that powers the lighting system. Other lengths of a tubular member can be provided. The tubular member is rigid so that it could be easily handled and installed into a conventional cabinet sign. The rigid tubular member also helps with wind loading in that the light sources (the LEDs) within the tubular member do not move or shake during a wind storm.

With reference back to FIG. 3, the LED modules 22 can be formed in a thin elongate paralleliped shape having two larger planar surfaces, e.g. front and rear, that have a greater surface area as compared to the remainder of the surfaces that define the paralleliped LED module. As will be seen and discussed below, the LED module can take many alternative configurations. Rectangular openings 144 extend through each module. The openings provide a material savings and may include a countersunk attachment hole.

The LEDs 26 can be any conventional LED. The LEDs 26 are provided in two sides, e.g. front and rear, of the LED module where some of the LEDs face in one direction and some of the LEDs face in an opposite direction. In other words, a plurality of LEDs face to illuminate a forward translucent panel of a cabinet sign such as the sign in FIG. 1 and a plurality of LEDs face rearward to illuminate a rear panel. With reference back to FIG. 4A, the PCB 24 (or similar support having circuitry for conveying electrical power to the LEDs) can be a double-sided PCB having LEDs positioned on a first (forward) surface and a second (rearward) surface.

The LEDs 26 on the forward side of the PCB 24 can be aligned with the LEDs on the rearward side, e.g. a line normal to the PCB and going through an LED on the front side of the board also goes through an LED on the rear side of the board. Alternatively, the LEDs on the forward side of the LED modules 22 can be offset or staggered from the LEDs on the rearward side of the LED modules. When connected with rigid spine, e.g. tubular member 44, the LEDs can be aligned along an axis, which is parallel to the longitudinal axis 62 (FIG. 2). The LEDs used can also be a grouping of multi-color LEDs such as red/green/blue to create multiple color effects or a specific backlighting color quality for the cabinet sign. Controls can also be internal to the modules to change colors as desired by the sign owner for ambient conditions or time of day or as a signal to viewers. Also, controllers can be used to dim the sign as desired in relation to ambient brightness to further conserve energy, something that is very difficult to accomplish with fluorescent lamps. The LEDs used can be used in conjunction with phosphor material present on or in the sign panel to create specific colors on the face of the sign.

With reference back to FIG. 4A, the PCB 24 that is depicted is a double-sided printed circuit board. In such a configuration, circuitry is printed on both of the larger planar surfaces of the PCB. Additionally, the PCB can be a metal core printed circuit board ("MCPCB") having electrically insulative material deposited on each larger planar surface of the PCB so that the metal core is in sandwiched between the insulative layers. Instead of providing a PCB to provide the electrical connections for the LEDs in each LED modules, a flex circuit or simple electrical wires could be provided to provide electricity to the LEDs. Moreover, the LEDs can be mounted to a printed wiring board (single-sided, e.g. FIG. 4B, or double sided), which is more particularly described in U.S. application Ser. No. 11/784,639, which is incorporated by reference.

With continued reference to FIG. 4A, the housing 32 protects the circuitry as well as the LEDs. The housing can encapsulate the PCB(s). The openings for the LEDs can be a funnel or conic shape to provide a reflective surface for the LEDs. The material from which the housing is made can be a reflective material. The reflective material near the LED can also be a separate reflector built into the design or a combination of reflector and optic to preferentially spread the light from the LED source to increase beam spread and improve panel illumination uniformity with fewer sources. Also, lenses can be placed over top of the LEDs to change the optical pattern for a broader overlap.

Although not shown in FIG. 2, if the spine (tubular member 44) is not included (the system would look similar to what is shown in FIG. 2) the housing 32 can be formed with mounting features that allow the module to easily attach to horizontal beams as well as vertical beams that can be installed in the cabinet sign (see U.S. provisional application Ser. No. 60/973,009). The mounting feature can include a set of ears each having an opening for a fastener. The fastener openings on the upper ears can intersect a horizontal line and each opening in an upper ear can align with an opening in a lower ear along a vertical line.

In an embodiment without a spine, the flexible electrical conductor 34 can electrically and mechanically interconnect the LED modules 22. The wires 38, 42 (FIG. 4) can interconnect with the circuitry found on each PCB 24 in each module. The wires can be soldered to the respective PCB or can attach via an insulation displacement connector (IDC) terminal or other similar connection. The housing 32 can be molded over the insulative material to protect the electrical wires and each electrical connector from the elements. The electrical wires 38, 42 connect to a power source (not shown) that drives the LEDs 22. The power source can also be located within the assembly to run from 110/220/277/480 VAC as provided from the local power company without having a separate module that converts wall plug volts to low voltage DC outside of the unit. Because so many LEDs can be found in a box sign, the LED system can accommodate the voltage drop without requiring the separate module.

FIGS. 8-11 depict an alternative embodiment of a lighting system for a cabinet sign. Each LED module 160 can connect to a beam (vertical or horizontal) that is connected to the sign housing 12 (FIG. 1). The components of the LED modules 160 that are shown in FIGS. 8 and 9 are similar to the components that are shown in FIG. 4A, in that each module includes a plurality of LEDs 162 that are mounted to a double sided PCB (not visible, but similar to PCB 24) having circuitry printed on the PCB. Each module also includes a housing 164 that covers the PCB. Alternatively, two single-sided PCB, can be placed back-to-back. Each module 160 is elongate, but the front and rear surfaces of each module, i.e. the surfaces having the largest surface area, are curved as opposed to being generally flat as shown in FIG. 3. The housing includes openings 166 through which the LEDs 164 emit light. A depression can be formed near each LED opening 166 to provide a reflective surface for the LED to encourage the LED to emit light in a desired pattern towards the translucent panel of the cabinet sign. As seen when comparing FIG. 8 (front view) to FIG. 9 (rear view) each LED module includes LEDs that face both the front and the rear. Accordingly, the PCB found in each LED module can be a double-sided printed circuit board or two printed circuit boards can be provided each having LEDs only on one side.

Each LED module 160 also includes a mounting feature. With reference to FIG. 8, through hole openings 168, which can include a counterbore, can extend from a front surface through the LED module to a rear surface so that a fastener or screw 172 (FIG. 9) can be inserted through the module. A flat obround washer 174 can receive the fastener 172 to provide a flat area for mounting the module 160 to a mounting beam (not shown) found in the sign housing.

The LED module design shown in FIGS. 8-10 reduces the wire connections when assembling the LED lighting system. The LED modules can snap together as shown in FIG. 10. With reference to FIG. 9, each LED module includes at a first end a male portion 180 that is received in a female portion 182 found at a second end of an adjacent module. The male portion 180 includes a tongue 184 that it fits into a slot 186 (FIG. 9) of an adjacent LED module 160. With reference to FIG. 10, the male portion 180 also includes a resilient tab 188 having a protuberance 192 that fits into a correspondingly shaped opening 194 in the female portion 182 of the adjacent LED module 160. A forward ramped surface of the protuberance encourages the tab to bend downwardly as it is inserted into the slot 186 prior to bending upwardly again so that the protuberance can be received in the opening 194. Electrical contacts 196 formed on the tongue 184 connect with electrical connectors (not seen) found in the female portion 182 of the adjacent LED module 160 to electrically connect the circuitry of one LED module to another.

Figure 11:
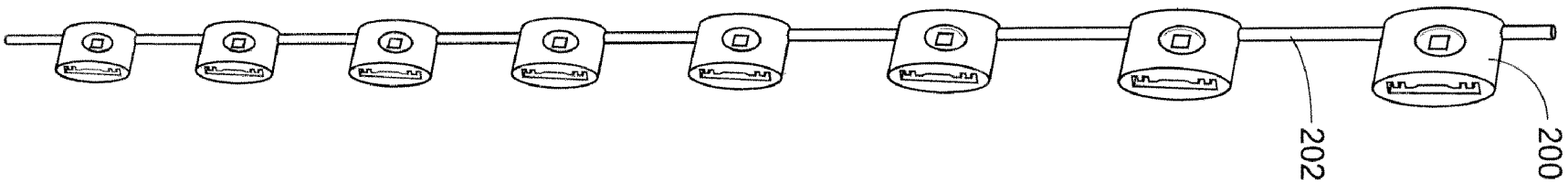
FIG. 11 is a perspective view of a plurality of end caps that connect the LED modules depicted in FIGS. 8 and 9.

With reference to FIG. 11, end caps 200 are provided connected to a flexible electrical connector 202 to provide a connection for the power to the LEDs 162 of the LED modules 160. The end caps 200 have an electrical and mechanical configuration similar to the female portion 182 (alternatively could have male configuration) of the each LED module 160 so that the male portion 180 can be inserted into the end caps 200 to provide an electrical connection for each of the LED modules. The electrical conductor 202 connects to the electrical conductors found in each of the end caps, which are similar to the electrical conductors in each of the female portion 182 of each LED module, to provide the electrical connection between the power source (not shown) and each module. The flexible electrical conductor 202 can be similar to the electrical conductor 34 shown in FIG. 3. The housing of each end cap can be overmolded around the insulative covering of the electrical connector.

Figure 12:
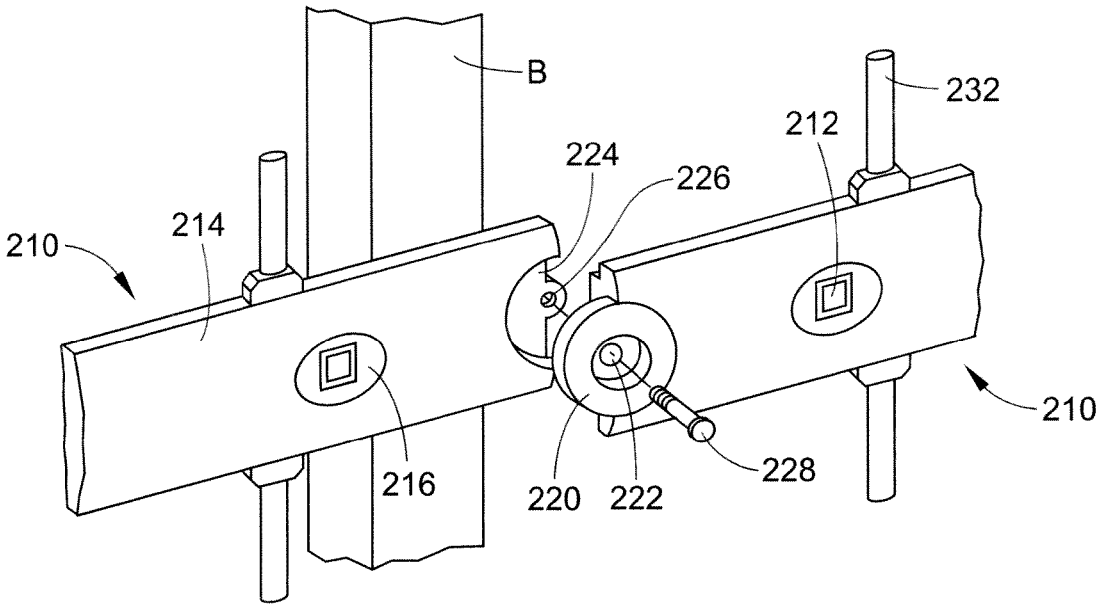
FIG. 12 is a front view depicting the connection of an LED module to another LED module for a lighting system for illuminating a box sign.
Figure 13:
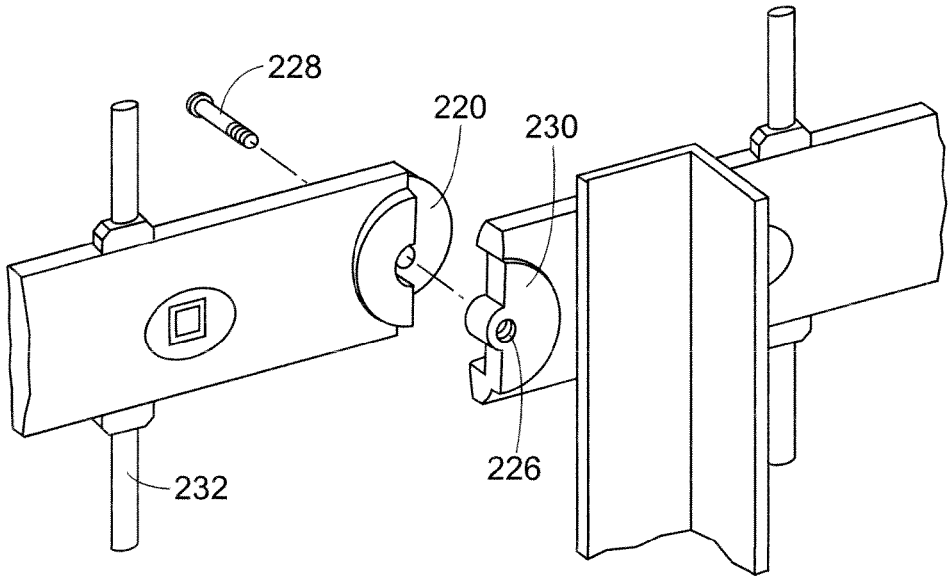
FIG. 13 is a rear view of the connection depicted in FIG. 12.

FIGS. 12 and 13 depict another embodiment of an LED backlighting system. The LED modules 210 connect to horizontal or vertical beams B (vertical beams are shown in FIGS. 12 and 13), which are connected to the housing of a cabinet sign. Each LED module 210 includes the same basic components as the LED modules that have been described above. Accordingly, each LED module 210 includes a plurality of LEDs 212. Some of the LEDs are facing in one direction (forward) and some of the LEDs are facing in an opposite direction (rearward). The LEDs 212 mount to a PCB, or other support that can carry electrical power. If a PCB is used, it can be a double-sided PCB, which has been described above. Furthermore, two PCBs each having the printed circuitry on one side can be abutted against one another so that the circuitry is located on opposite sides of the LED module 210.

Each LED module also includes a housing 214 that covers the PCB and the respective circuitry. The housing 214 has a front surface and a rear surface. LED openings 216 are formed in the front surface and the rear surface. Light emitted from the LEDs 212 is emitted from both the front surface and the rear surface of the LED module 210.

Each LED module 210 includes a tongue 220 that is generally half circular in configuration that includes a centrally disposed opening 222. Each LED module 210 also includes a half circular depression 224 that is configured to receive the half circular tongue 220. Accordingly, the tongue 220 and the depression 224 can take alternative configurations; however, a complementary configuration of the tongue with respect to the depression is typically desired. An opening 226 extends through the LED housing in the area of the depression 224 to align with the opening 222 in the tongue 220. The openings 222 and 226 align with each other when the tongue 220 is inserted into the depression 224 so that a fastener 228 can be used to attach the LED modules 210 to the vertical beam B (could alternatively be a horizontal beam). Since each LED module 210 includes a half circular tab and a half circular depression, the LED modules can be rotated about an axis that is generally normal to the front and rear surfaces of the LED module and aligned with the central LED so that the half circular tongues can align with corresponding half circular depressions in adjacent LED modules. As more clearly seen in FIG. 13, the rear side of each LED module in a location on the opposite side of the half circular depression 224 has a generally planar surface 230 to facilitate attachment of the LED module 210 to the beam B and not have the LED module rock as it is being attached or while it is attached to the beam.

The LED modules are also mechanically connected and electrically connected to one another by electrical cords 232 that are similar to flexible electrical conductors described above. Accordingly, the electrical cord 232 is in electrical communication with the circuitry of the PCB(s) of each LED module 210 and can be connected to the PCB(s) via soldering or an IDC terminal or a similar type of electrical and mechanical connection. Furthermore, the electrically insulative material of the flexible electrical conductor 232 can also be overmolded in the vicinity of the housing 214 when manufacturing the LED modules.

Figure 14:
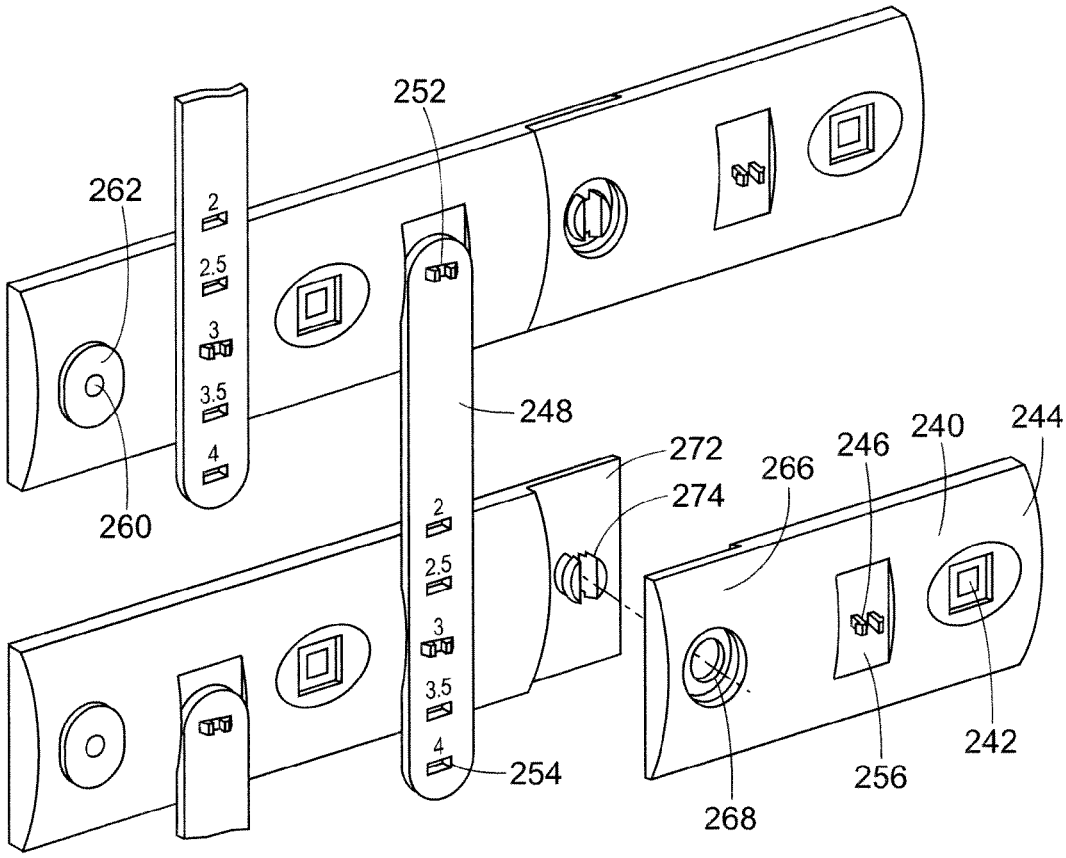
FIG. 14 is a close-up view of another embodiment of a lighting system for illuminating a box sign.

With reference to FIG. 14, an alternative embodiment of an LED module 240 is shown. The LED module 240 is similar to those described above in that it includes a plurality of LEDs 242 that are disposed on opposite sides (front and rear) of the module. Each LED module 240 can include a PCB and circuitry disposed on the PCB to provide electrical power to the LEDs. Alternatively, each LED can be disposed on a flex circuit or simply wired and electrically connected to one another.

Each LED module includes a housing 244 that covers the printed circuit board and any circuitry that provides an electrical connection for the LEDs 242. Similar to the embodiments described above, the housing can be viewed as having a front surface where the LEDs are arranged generally parallel to the front surface so that the LEDs illuminate a front panel of a cabinet sign. Each LED module 240 also includes a rear surface and LEDs 242 that are generally aligned parallel with the rear surface to illuminate a rear panel of the cabinet sign. As with the embodiments described above, more than one PCB each having circuitry disposed on an opposite surface for providing light to the front LEDs and the rear LEDs of each LED module can be provided, or a double-sided printed circuit board can be provided.

Each LED module 240 is provided with a number of connection members. A first set of connection members allows adjacent LED modules that are offset from one another in a direction that is generally perpendicular to the longest dimension (the length) of each LED module. In the depicted embodiment, a plurality of resilient tabs 246 are disposed on either a front and a rear surface, or both, of the housing 244. More particular to the depicted embodiment, the connection tabs 246 are disposed in pairs and are configured to cooperate with a link 248. Each link includes a first (upper) opening 252 that is adjacent a first (upper) end of the link and a plurality of second (lower) openings 254. For the embodiment shown in FIG. 14, five lower openings 254 are disposed vertically spaced from the uppermost opening 252. Each second (lower) opening 254 can correspond to a desired spacing so that the LED module directly above or directly below the subject LED module is offset a desired dimension from the subject LED module that connects to the upper opening 252. In the depicted example, the lower openings 254 are offset ½ of a unit (centimeter or inches) from one another. Additionally, the sets of tabs 246 emanate from a generally planar surface 256 that has a dimension that is generally parallel with the length of each LED module 240 that is about equal to the width of the link 248. Accordingly, the link nicely fits in this planar surface that also generally defines a recess. The snap on link 248 provides vertical spacing between horizontally aligned LED modules. These can also provide horizontal spacing when horizontal beams are provided inside of the cabinet sign.

Each LED module 240 also includes throughhole 260 that extends entirely through the module and, possibly, any PCB inside the module to allow for the module 240 to attach to a vertical (or horizontal) beam within a cabinet sign. The throughholes 260 can also be disposed adjacent a planar surface 262 which is also facilitates connection to the beam. Each module and its PCB can similarly be mounted to structure within the cabinet sign that both provides support as well as thermal dissipation of energy from the LED system to assist in thermal management of the heat conducted from the LEDs.

Each LED module 240 also includes a tongue 266 having an opening 268 disposed at one end of the LED module and a second tongue 272 and pair of barbs 274 disposed at an opposite end. The barbs 274 extend generally normal from a planar surface of the tongue 272 and are configured to be received via a snap fit into the opening 268 of the first tongue 266 to attach to adjacent LED modules 240. Accordingly, only a mechanical connection between adjacent modules is provided. An electrical wire or electrical conductor similar to those that have been described above, can electrically interconnect the LED modules. The electrical connector also connects to an associated power source to provide electrical power to the LED modules. The LED modules 240 can be shipped to the site with mixed lengths of LED modules and a plurality of links.

Figure 15:
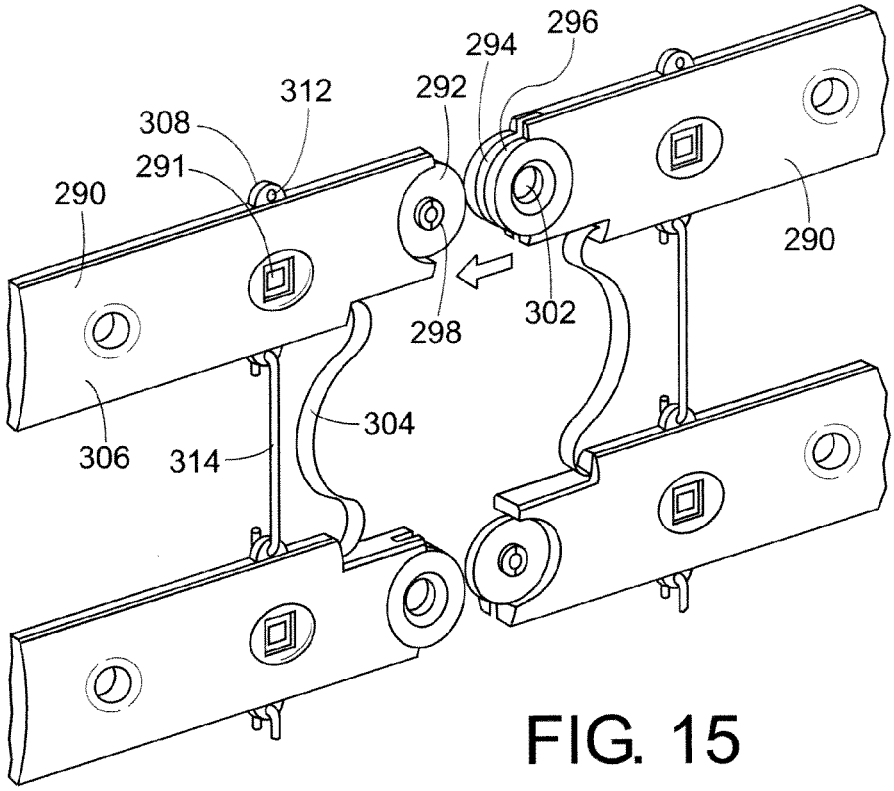
FIG. 15 is a close-up view of another alternative embodiment of a portion of a lighting system for illuminating a box sign.
Figure 16:
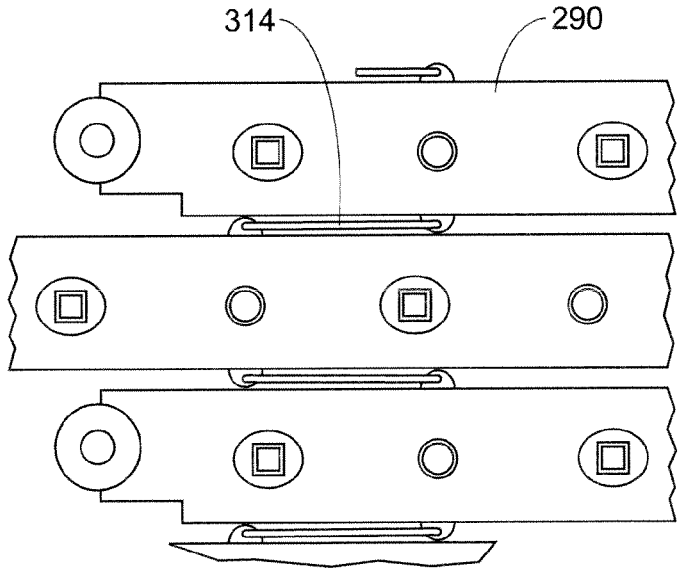
FIG. 16 is a close-up view of the lighting system in a "knocked-down" configuration.

FIGS. 15 and 16 depict another embodiment of an LED module 290 that forms a component of an LED lighting system used to illuminate a cabinet or box sign. The LED module 290 is generally the same as the LED modules described above in that it can include a PCB and a plurality of LEDs 291 on opposite sides of the LED module. As seen in FIG. 15 each LED module 290 snaps together with one another. This embodiment, however, only provides a mechanical connection, as opposed to both a mechanical and an electrical connection. More specifically, each LED module 290 includes a tongue 292 at one end and at an opposite end a groove 294 defined between opposite tabs 296. A circular protuberance 298 on the tongue 292 is received in respective openings 302 in each of the tabs 296 when the tongue 292 is received in the groove 294. The protuberance 298 is ramped.

Each LED module housing 306 can also include ears 308 each including openings 312 that receive wire links 314 to further mechanically connect one LED module 290 to an adjacent LED module. The LED modules can be knocked down and packed as shown in FIG. 16. The LED modules 290 are electrically connected together using flexible electrical conductors 304, similar to those described above.

Figure 18:
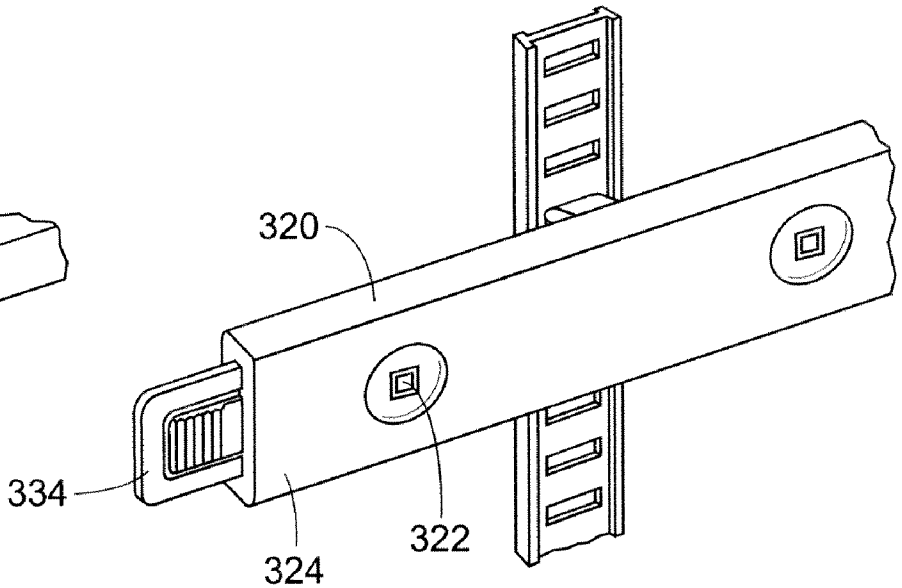
FIGS. 17-19 disclose steps for mounting a lighting system in a box sign.
Figure 17:
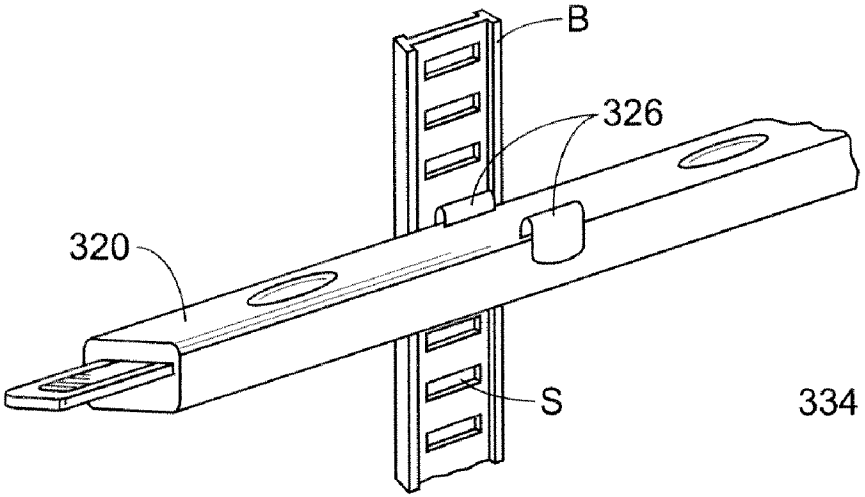

FIG. 17 depicts attaching an LED module 320 to a vertical beam B having a plurality slots S in the beam. The LED modules 320 are similar to those described above in that they each include a PCB (not visible), LEDs 322 on each side of the printed circuit board (or two PCBs) to illuminate opposite sides of the cabinet or box sign and a housing 324 covering the PCB. The housing 324 is formed with tabs 326 that fit into slots S formed in the vertical beams B. Attachment of the LED module 320 to the beam B is shown in steps depicted in FIGS. 17-18.

Figure 19:
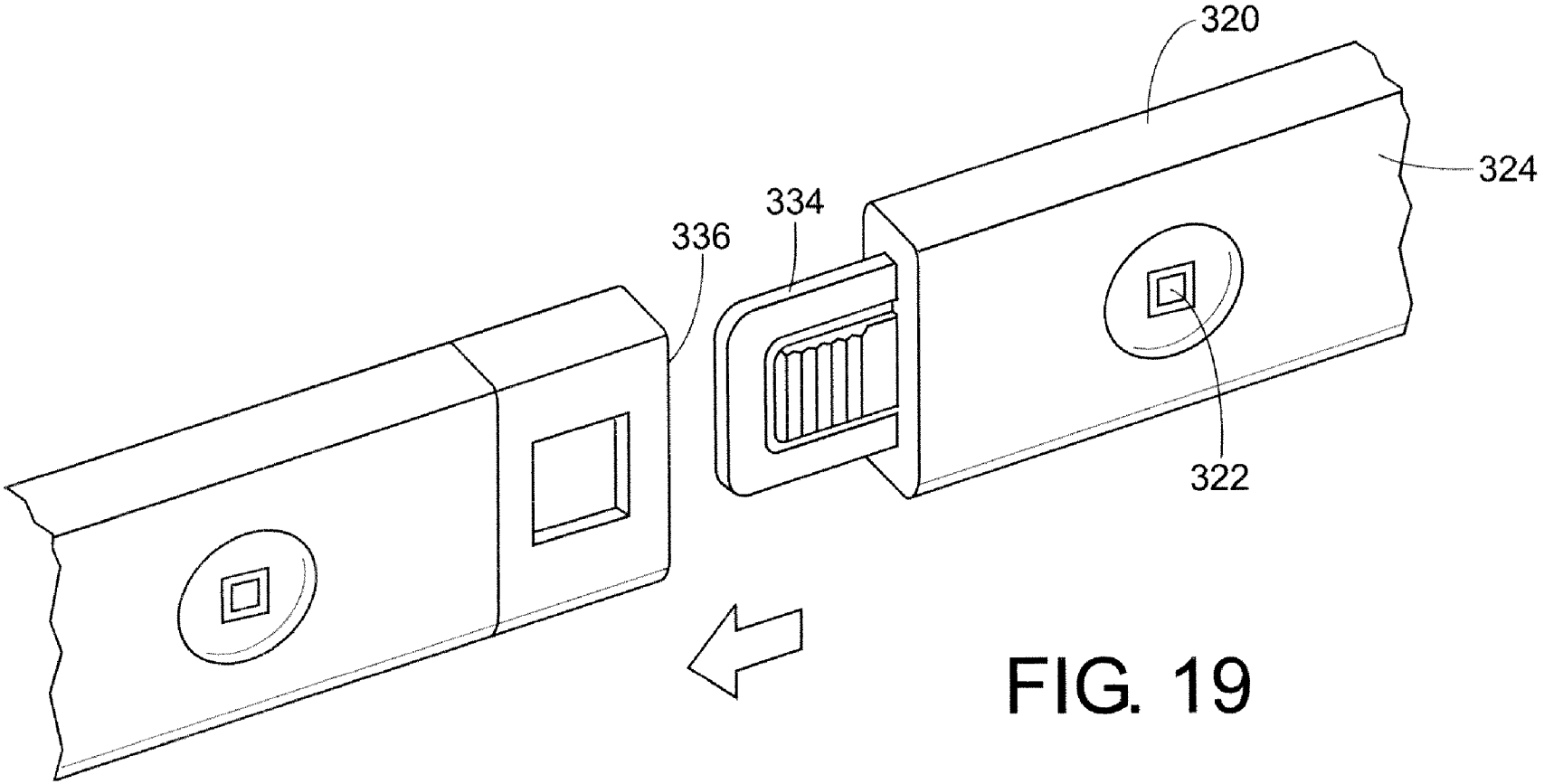

Each LED module 320 is also formed with a male section 334 at one end that fits into a female section 336 (FIG. 19) at another end of an adjacent LED module to attach to the modules together. Electrical contacts similar to the embodiment described with the reference to FIG. 10 can be provided in this arrangement as well. As an alternative the housing for each LED module can have wings that fit into a beam having flanges.

Figure 20:
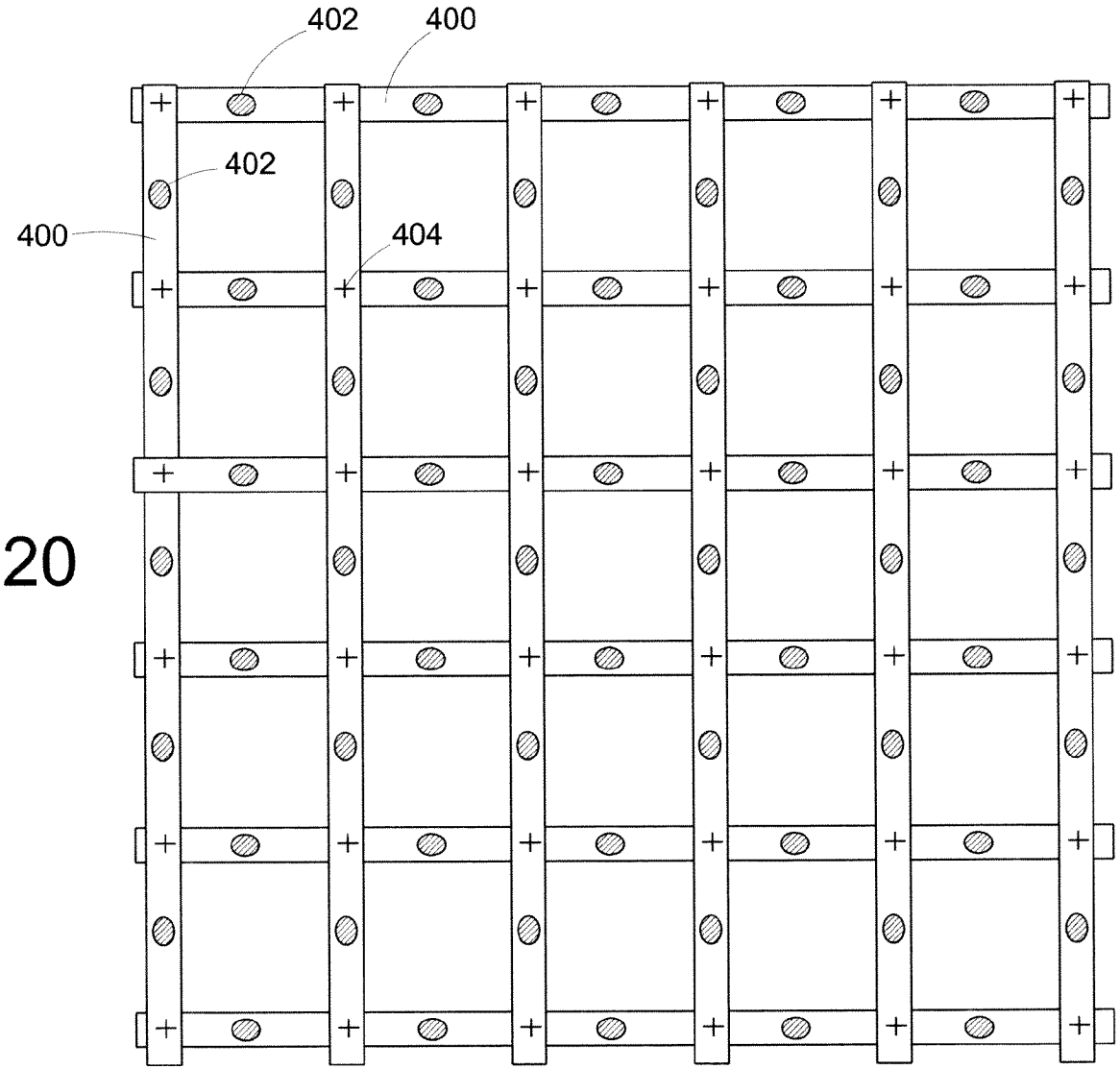
FIG. 20 is schematic depiction of another alternative embodiment of a lighting system for illuminating a box sign.

With reference to FIG. 20, an LED backlighting system including a plurality of LED modules 400 is disclosed. The LED modules 400 are similar to those described above but are depicted schematically. Each module includes a plurality of LEDs 402. The LEDs 402 can be facing both the forward and rearward direction (FIG. 20 is a plan view so that the LEDs facing in the rearward direction are not visible). The LEDs 402 can be equidistantly spaced from one another. Disposed an equal distant between adjacent LEDs is a connection location 404 which is depicted schematically with a "+". The connection can simply be a throughhole that extends through the LED module. The connection can also be similar to the connection depicted in FIG. 14 except for that the LED modules are allowed to rotate with respect to one another which will be described in more detail below.

Figure 21:
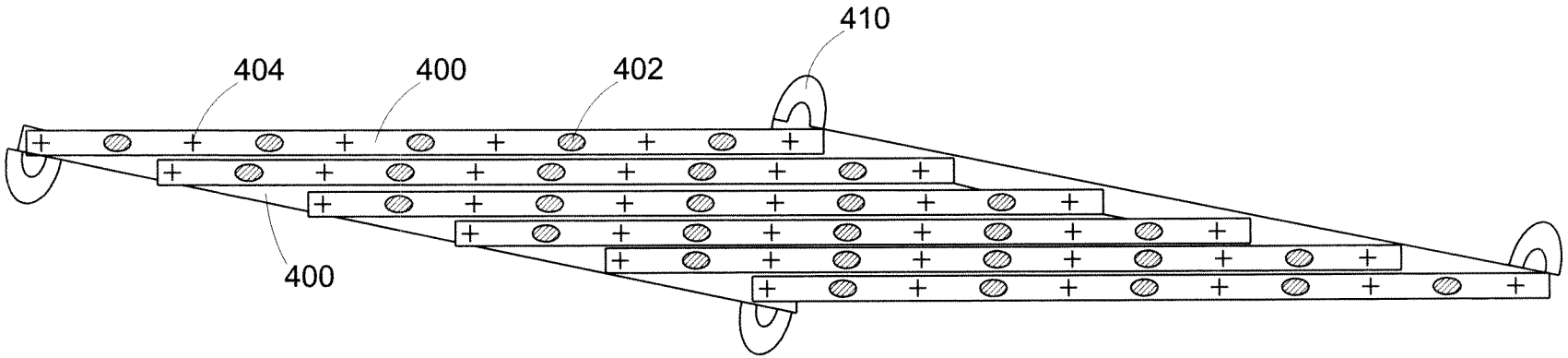
FIG. 21 depicts a "knocked-down" lighting system shown in FIG. 20.

With reference to FIG. 21, the linkage that is shown in FIG. 20, can be compressed or "knocked down" to facilitate shipping the LED backlighting system. Accordingly, the LED backlighting system is similar to a four-bar linkage, which can be easily assembled inside of a cabinet sign. FIG. 21 also depicts mounting loops 410 attached to the knocked-down lighting system depicted in FIG. 20. A plurality of lighting systems similar to that shown in FIG. 20 can be attached to one another to illuminate the large cabinet sign. "Half" panels can be provided in a generally triangular configuration.

Figure 22:
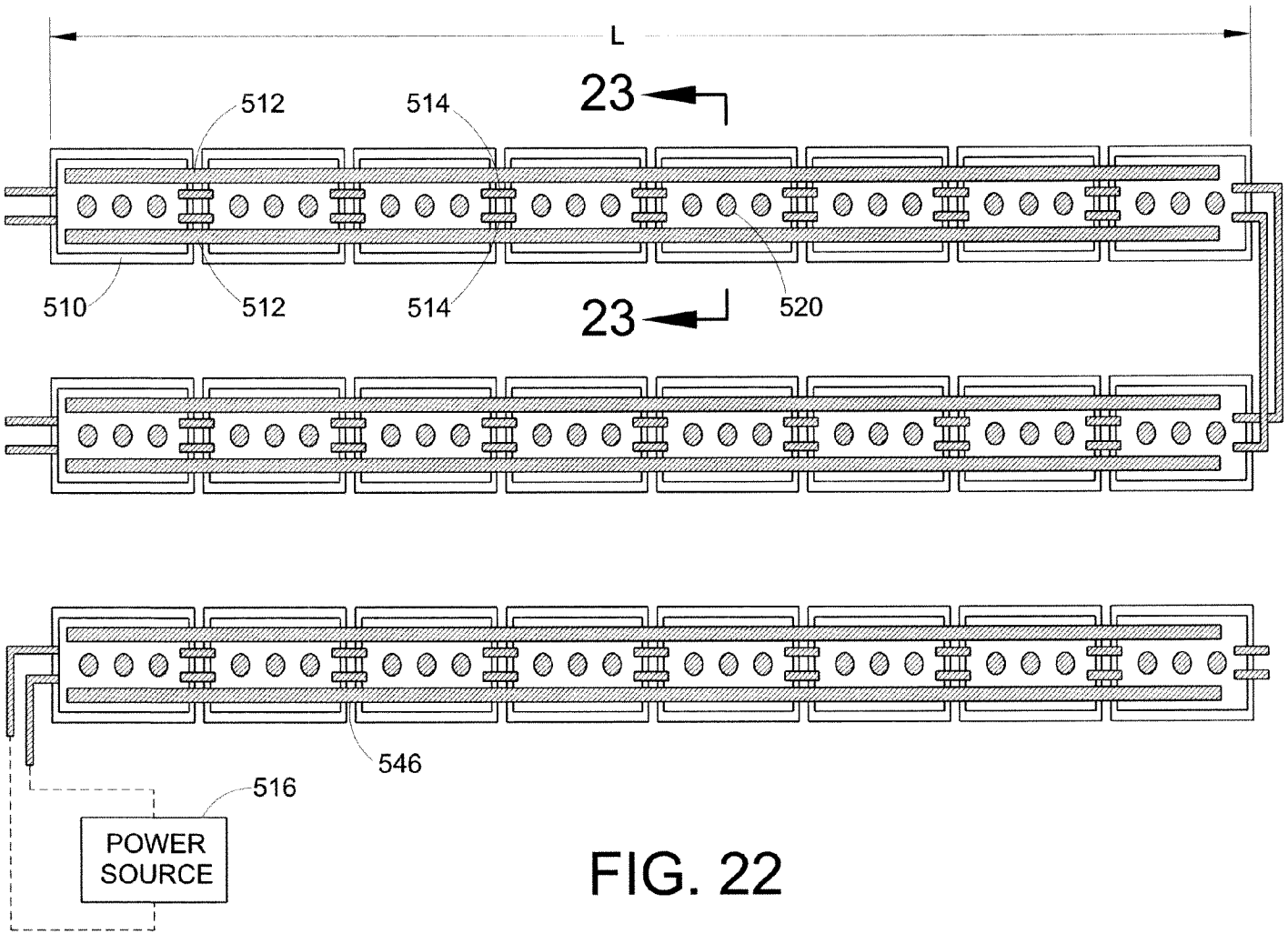
FIG. 22 is a schematic depiction of a system for illuminating a box sign, such as the box sign shown in FIG. 1.

With reference to FIG. 22, a lighting system for illuminating a box sign, such as the cabinet or box sign shown in FIG. 1, generally includes LED modules 510, spines 512 interconnecting at least some of the LED modules, flexible electrical connectors 514 interconnecting LED modules, and a power source 516. The LED lighting system mounts inside a box sign and illuminates the translucent panels, such as translucent panel 14 shown in FIG. 1. Using LEDs, instead of fluorescent tubes, as the light source provides a system that is capable of directing nearly all of the light that is generated by the system toward the panels, which increases efficiency.

Figure 23:
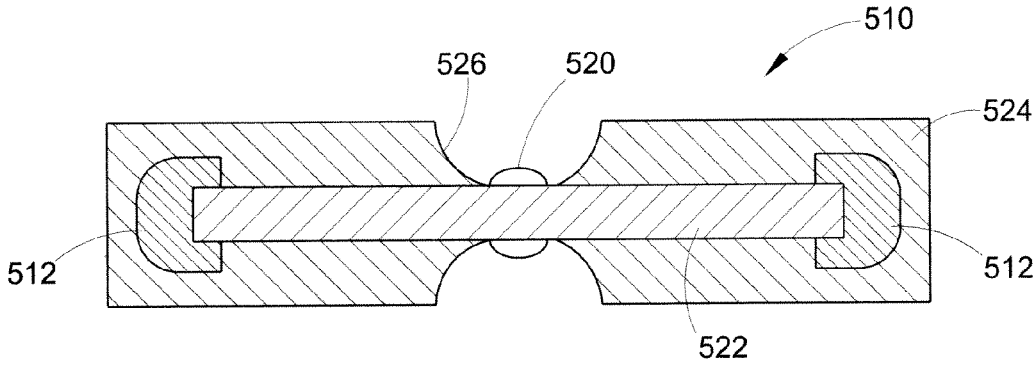
FIG. 23 is a cross-sectional view taken along line 23-23 in FIG. 22.

With reference to FIG. 23, the LED modules 510 for the back lighting system can take many different configurations, examples of which were more particularly described above. Each LED module 510 generally includes a plurality of light emitting diodes ("LEDs") 520 that are mounted on a PCB 522 having printed circuitry (not shown). A housing 524 covers the PCB 522, the circuitry, and if desired some of each LED 520. Openings 526 are provided in the housing 524 to allow light from the LED 520 to radiate towards the translucent panels of the cabinet or box sign.

The LED modules 510 can be formed in a thin elongate paralleliped shape having two larger planar surfaces, e.g. front and rear, that have a greater surface area as compared to the remainder of the surfaces that define the paralleliped LED module.

The LEDs 520 can be any conventional LED. The LEDs 520 are provided on two sides of the LED module, which for the sake of brevity will be referred to as a front side and a rear side. When the LED lighting system is disposed inside a box sign, the LEDs on the front side of the LED modules illuminate the front translucent panel of the box sign and the LEDs on the rear side of the LED module illuminate the rear translucent panel of the LED box sign. LED openings 526 in the housing 524 can be formed and shaped to provide a reflective surface to direct the light emitted from the LEDs 520 toward a desired location of the translucent panel that the LEDs are to light. The shape of the opening 526 can be designed to accommodate for the spacing between adjacent LEDs both vertically and horizontally in the box sign to provide uniform illumination on the translucent panel that is to be illuminated by the system. The LEDs 520 on the forward side of the printed circuit board 522 can be aligned with the LEDs on the rearward side of the printed circuit board.

With reference to FIG. 23, the PCB 522 can be a double-sided PCB. In such a configuration, circuitry can be printed on both of the larger planar surfaces of the PCB. Additionally, the PCB can be a metal core PCB having electrically insulative material deposited on each larger planar surface of the PCB so that the metal core is in sandwiched between the insulative layers. Instead of providing a PCB to provide the electrical connections for the LEDs in each LED module, a flex circuit or simple electrical wires could be provided to provide electricity to the LEDs. Moreover, the LEDs can be mounted to a printed wiring board (single sided or double sided).

The housing 524 protects the circuitry as well as the LEDs 520. The housing 524 can encapsulate the printed circuit board 522. With reference to FIG. 23, the openings 526 for the LEDs 520 can be a funnel or conic shape to provide a reflective surface for the LEDs. The material from which the housing is made can be a reflective material. The reflective material near the LED 520 can also be a separate reflector built into the design or a combination of reflector and optic to preferentially spread the light from the LED source to increase beam spread and improve panel illumination uniformity with fewer sources. Also, lenses can be placed over top of the LEDs to change the optical pattern for a broader overlap. The housing can be formed with mounting features that allow the module to easily attach to horizontal beams as well as vertical beams found inside a conventional box sign.

Figure 24:
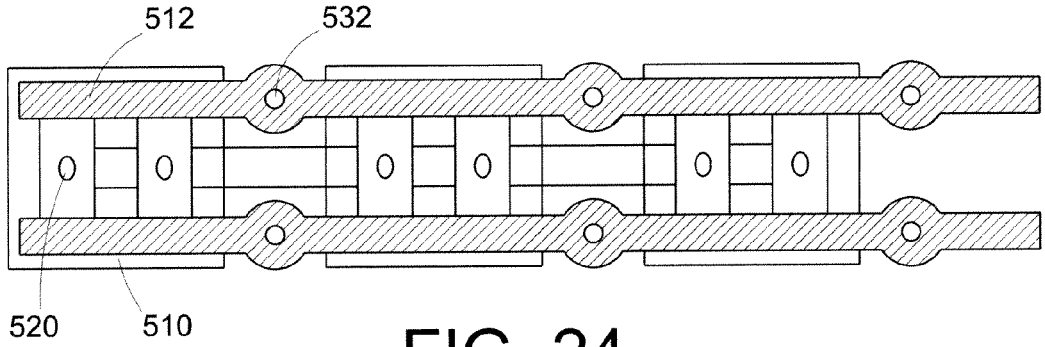
FIG. 24 is a schematic depiction of an alternative embodiment of an LED lighting system for illuminating a box sign.

The LED lighting system also includes a spine 512, or spines, that interconnect LED modules 510. With reference to FIG. 24, the spines 512 can also provide mounting locations, for example by providing holes 532 for fasteners. The spine supports the printed circuit board 522 of the LED module during application of the overmolded housing 524. The spine 512 can also support the flex circuit or another flexible support to which an LED can mount, for example where the LEDs are not mounted to a PCB (see FIG. 24). Each spine 512 can be made from a rigid plastic, or similar rigid material, and connect to the printed circuit board 22 (or other support for the LED).

The spines 512 shown in FIG. 23 are shown as attached to lateral sides of the printed circuit board. Alternatively, the spine, or spines, can connect to a forward or rearward surface of the printed circuit board. For example, the spine can include pegs that are received in corresponding holes found in each PCB. The spines 512 can include a channel into which the printed circuit board is attached via a friction or resilient fit. Alternatively, the spine can attach to the printed circuit board via welding, or mechanical fastener, crimping the spine to the PCB and other manners.

Figure 26:
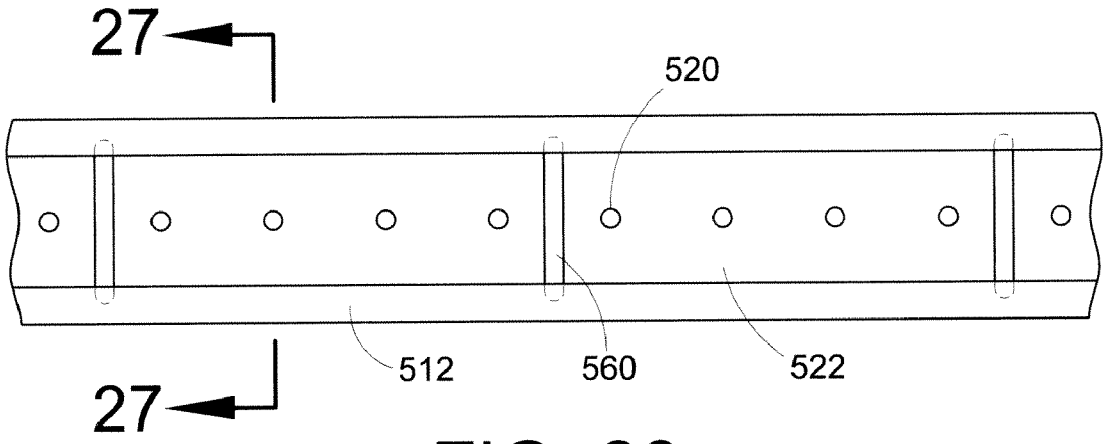
FIG. 26 is a schematic depiction of an alternative embodiment of a system for illuminating a box sign.
Figure 27:
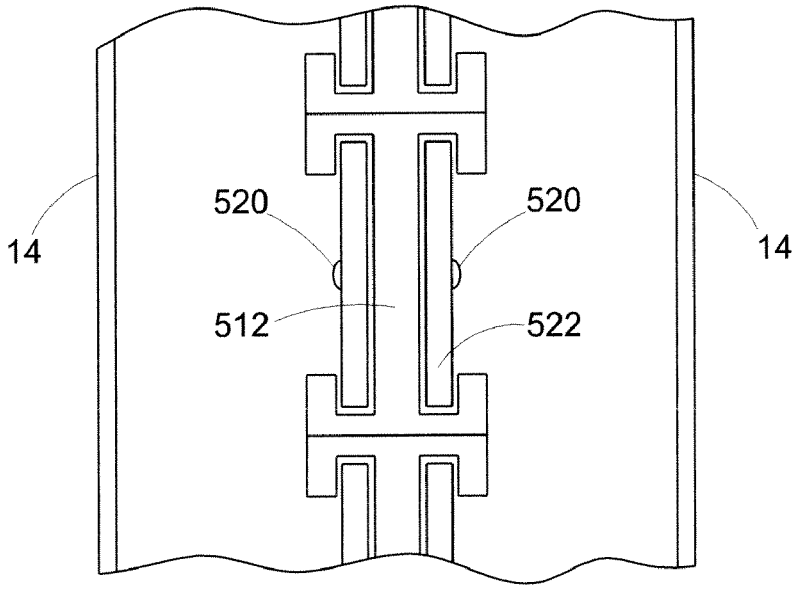
FIG. 27 is a cross-sectional view taken along line 27-27 in FIG. 6, however only one strip of the LED system shown in FIG. 26 is shown in FIG. 27.

With reference to FIGS. 26 and 27, the spine 512 is shown receiving an elongate PCB 522. The PCB 522 can include elongate openings 560 that are similar to the cut locations and weakened sections that are described above. Instead of providing an overmolded housing, the circuitry of the circuit board 522 can be sprayed or covered with a material to protect the circuitry from the elements while not providing the more robust protection as compared to the overmolded housing described above.

As more clearly seen in FIG. 27, the spine 512 includes two channels that each receive a printed circuit board 522. LEDs 520 on one side of the LED system illuminate one translucent panel 14 of a cabinet or box sign and LEDs on the other side of the spine illuminate the other translucent panel. The spines 512 can be stacked on top of one another or next to one another as shown in FIG. 27 and the PCBs can then be inserted or slid into these channels. The spines 512 can be configured to attach to one another along their respective longer edges, e.g. a tongue and groove connection.

With reference back to FIG. 22, the spine 512 can be used to interconnect a set of LEDs that are found in the lighting system so that the set of LEDs have a desired length L, for example four feet. The length of the set of LEDs can be a function of the box sign into which the lighting system is to be placed. For example, where the box sign has a horizontal dimension of roughly about four feet, then the length L of the set of LED modules that are attached by one spine can be approximately four feet. The length of the set of LED modules that are attached by a single spine (or spines used to connect the same LEDs) can be varied so that when a sign installer orders the LED lighting system, the installer can specify the length L of the LED module set to accommodate the box sign into which the LED system will be placed. This provides the LED system much more flexibility as compared to a box sign that is illuminated by fluorescent tubes. Moreover, by providing the spine 512, or spines, a rigid light-emitting bar is provided inside the box sign. The rigid bar facilitates mounting the system inside the box sign.

With reference back to FIG. 22, multiple sets of LED modules 510 attached to a spine 512, or spines, can be provided each having the same length L. The sets of LEDs each having the same length L can then be mounted inside of a box sign and spaced vertically or horizontally from one another.

Flexible electrical connectors 514 interconnect the LED modules 510 as well as the module sets. The electrical connectors 514 typically include a plurality of wires that are covered by an electrically insulative material. The wires interconnect with the circuitry found on each printed circuit board 522 in each module 510. The wires can be soldered to the respective printed circuit board or can attach via an IDC terminal or similar connection. The housing 524 can be molded over the insulative material of each electrical connector 514 to protect the electrical wires in each electrical connector from the elements.

The spine 512 can also carry electricity to replace the flexible electrical wires. For example, the spine 512 can be made from metal and contact the circuitry that is printed on each circuit board.

Figure 25:
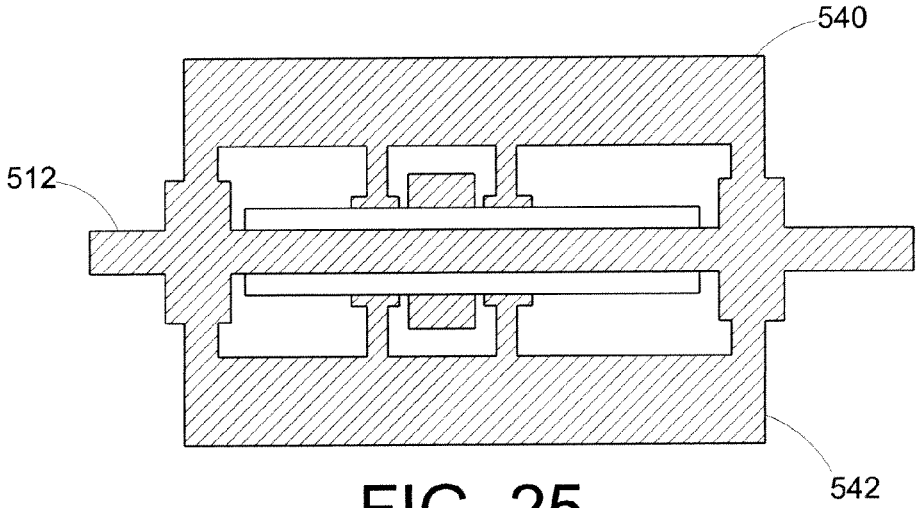
FIG. 25 is a schematic depiction of the manufacturing process for manufacturing the LED systems shown in FIGS. 22 and 24.

FIG. 25 depicts the process by which the lighting system can be manufactured. As seen in FIG. 25, an upper mold 540 and a lower mold 542 are provided to manufacture the overmolded housing 524. The spine 512 provides an indexing feature for the overmolded housing. The spine provides a location function by which defines the perimeter of the overmolded housing.

With reference back to FIG. 22 cut locations 546 are provided by the spacing between adjacent LED modules 510. The openings 532 (FIG. 4) can also provide a cut location between adjacent modules. A drill bit having a diameter larger than the diameter of the opening 532 is inserted into the opening to cut through the material that surrounds the opening. The spine can also include weakened sections (e.g. notches) that can be easily snapped in addition to or in lieu of cut locations.

Figure 28:
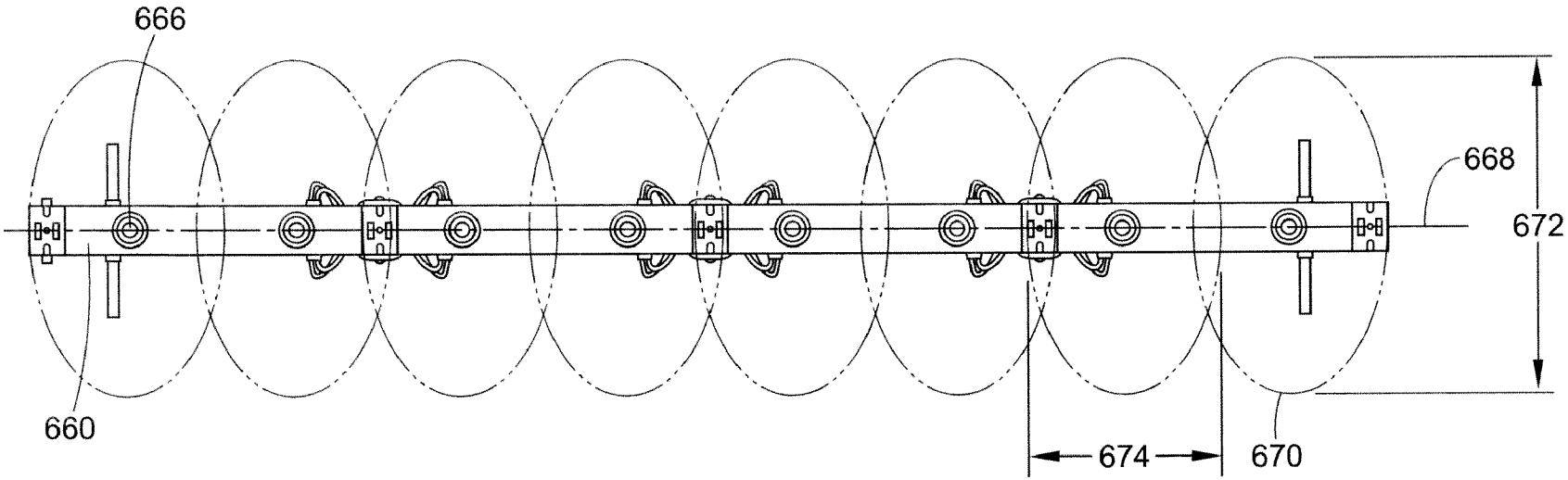
FIG. 28 is a plan view of a lighting system for illuminating a box sign having exemplary light beam patterns shown for each LED and optic combination for the lighting system.
Figure 29:
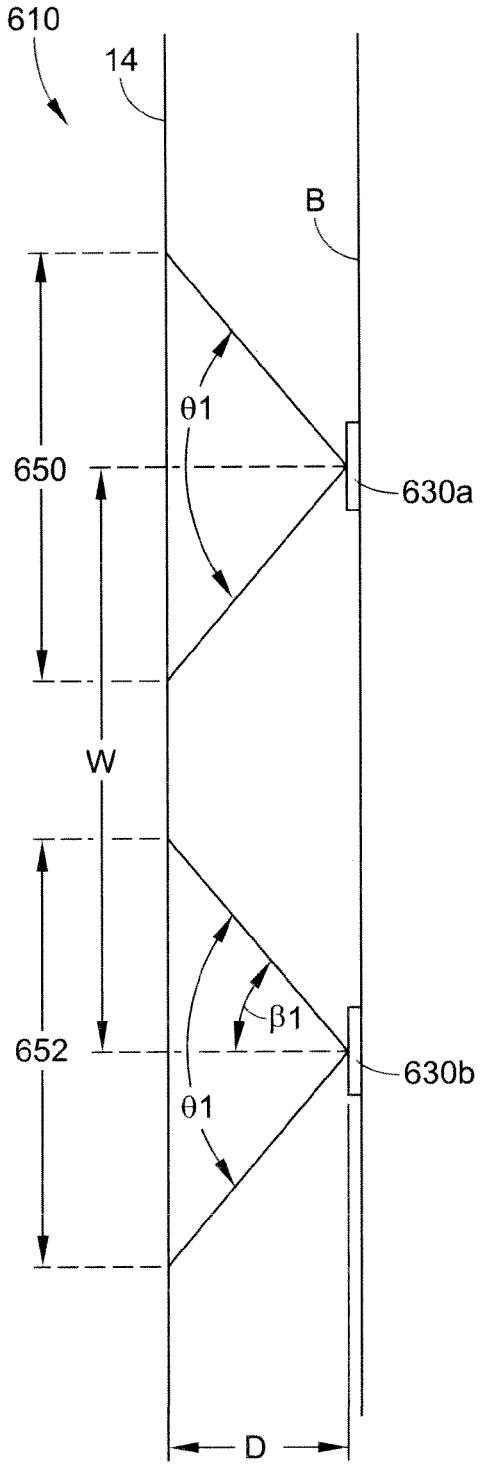
FIG. 29 is a schematic vertical cross-sectional depiction of a lighting system shown in a box sign, where the lighting system does not include a beam spreading optic.
Figure 30:
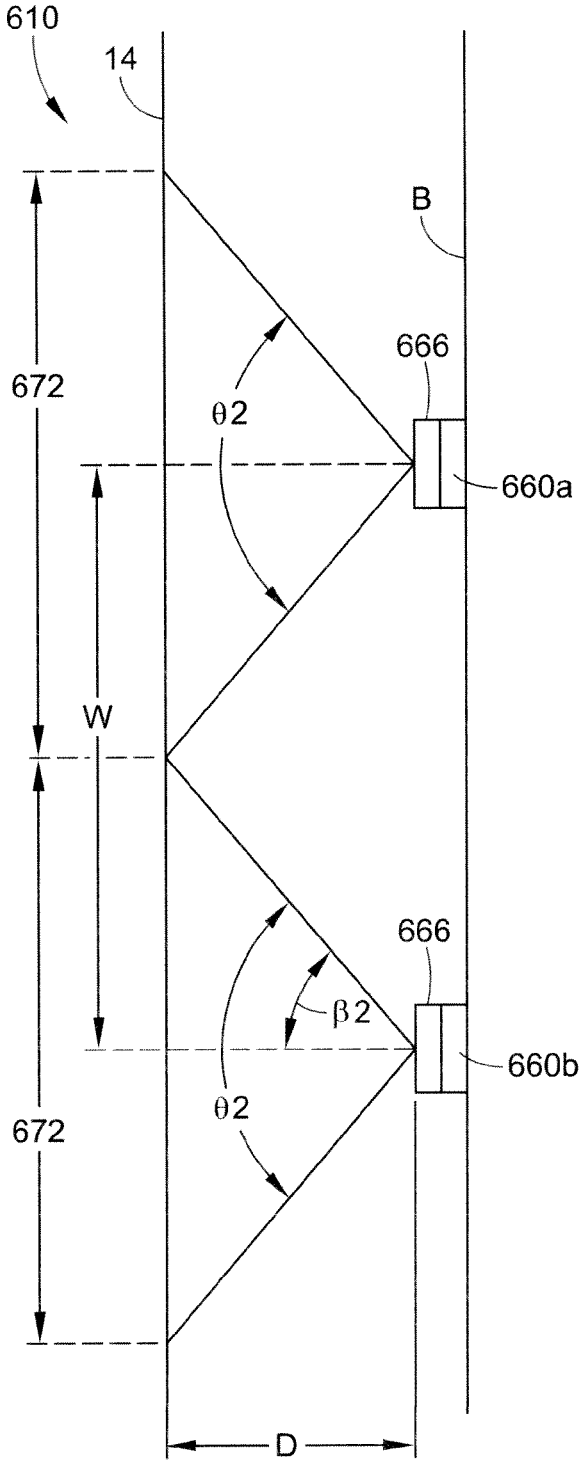
FIG. 30 is another schematic vertical cross-sectional depiction of a lighting system including an optic in the same box sign as that schematically depicted in FIG. 29.
Figure 31:
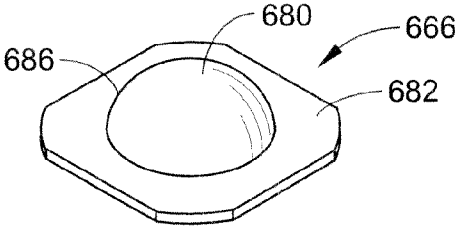
FIG. 31 is a perspective view of a lens for a lighting system.
Figure 32:
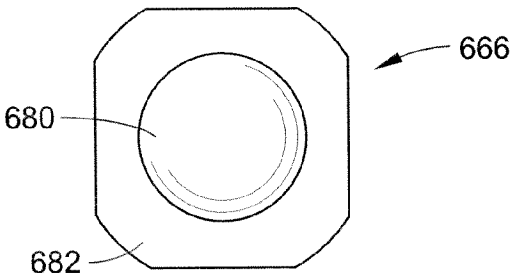
FIG. 32 is a top plan view of the lens shown in FIG. 31.
Figure 33:
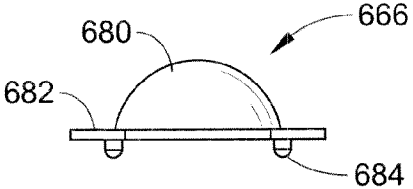
FIGS. 33-35 are side elevation views of the lens shown in FIG. 31.
Figure 34:
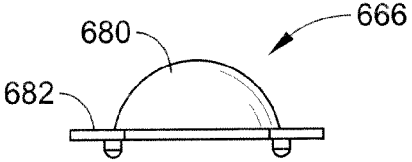
Figure 35:
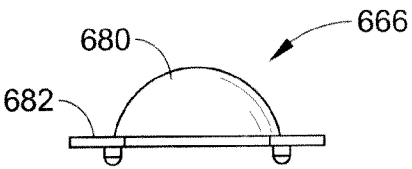
Figure 36:
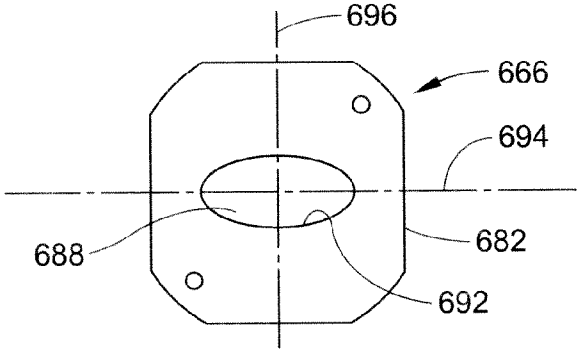
FIG. 36 is a bottom plan view of the lens shown in FIG. 31.

With reference to FIG. 28, LED modules 660 are shown including LED lenses 666 that cooperate with the respective LEDs (not visible) to preferentially spread light emitting from each LED. FIGS. 29 and 30 schematically depict LED lighting systems disposed in a box sign. FIG. 29 depicts LED modules 630*a* and 630*b* attached to a vertical beam B. The LED modules 630*a* and 630*b* are just two modules of many modules. The LED modules 630*a* and 630*b* are spaced a vertical distance W from one another (center to center spacing between the LEDs of the adjacent modules). The LED modules 630*a* and 630*b* are spaced a distance D from the translucent panel. In other words, the LED modules 630*a* and 630*b* are spaced from a target plane, which is the translucent cover 14 in this example, a distance D measured normal to the target plane. Each of the LEDs for the LED modules 630*a* and 630*b* has a primary viewing angle $\theta 1$, which is defined by where the LED's luminous intensity on a plane spaced from the LED is about one-half the intensity on the plane at the direct, on axis view.

As seen in FIG. 29, the LED in the upper LED module 630*a* generates a first primary beam pattern 650 and an LED on the lower LED module 630*b* generates a second primary beam pattern 652. There is no beam spreading optic associated with the LEDs. The beam patterns 650 and 652 that are generated on the target plane are bounded by the off-axis angle $\beta 1$, which is $\theta ½$. In this example, the beam patterns 650 and 652 are generally circular being the base of a cone having a cone angle $\theta 1$ and a vertex at the respective LED. In this example, $\tan \beta 1 < (W/2)/D$. In the example depicted in FIG. 29, the light intensity at the target plane (the translucent panel 14) would not be uniform due to the darker areas between the adjacent beam patterns, i.e. where the beam patterns do not coincide, overlap or are in close proximity. Where the horizontal space between LEDs remains the same, while the vertical space between LEDs is increased, uniformity of light on the translucent panel of the box sign could be improved by directing more light away from a longitudinal axis of each LED module (the longitudinal axis being the axis in which the centers of the LEDs reside). Accordingly, a beam pattern similar to that shown in FIG. 28 would be useful.

FIG. 30 schematically depicts LED modules 660, shown as an upper LED module 660*a* and a lower LED module 660*b*, disposed in the same sign as that schematically depicted in FIG. 29. The LEDs are spaced the same distance D from the translucent panel 14 and are also spaced the same vertical distance W from one another.

In contrast to FIG. 29, lenses 666 cooperate with the LEDs on the respective LED modules 660*a* and 660*b* to broaden the off-axis angle $\beta 1$ in FIG. 29 to an off-axis angle $\beta 2$. The off-axis angle $\beta 2$, however, is broadened more in a direction that is perpendicular to a longitudinal axis 668 of the LED modules 60 (see FIG. 28). The lenses 666 redirect light from the respective LEDs such that the boundary where the LED's luminous intensity is about one-half the intensity at the direct, on-axis view is widened from that of the LED alone.

With reference to FIG. 28, the lenses 666 cooperate with the respective LED of each LED module 660 to produce an altered beam pattern 670 (as compared to the beam patterns 650 and 652 in FIG. 29). In the embodiment depicted in FIG. 28, the altered beam pattern 670 is generally elliptical having a major axis 672 that is perpendicular to the longitudinal axis 668 and a minor axis 674 that is parallel to the longitudinal axis 668. The altered beam pattern 670 need not be elliptical; however, it is desirable to have the beam pattern have a longer dimension perpendicular to the longitudinal axis 668 where the rows of LED modules are spaced further from one another in a direction perpendicular to the longitudinal axis 668 as compared to the spacing between adjacent LEDs along the longitudinal axis 668. This is particularly desirable when the LED lighting system is used to retrofit an installation having fluorescent tubes. This allows the rows of adjacent LED modules to be vertically spaced further apart from one another which lessens the amount of LED modules required to illuminate the box sign.

With reference back to FIG. 30, the viewing angle in the direction perpendicular to the longitudinal axis 668 (FIG. 9) is such that the altered beam patterns 670 are bounded by an off-axis angle β2. The off-axis angle β2, similar to the off-axis angle β1, is where the luminous intensity of light emanating from the respective LED and redirected by the lens 666 is about half the luminous intensity of the on-axis luminous intensity for the respective LED in combination with the respective lens 666. The off-axis angle β2, however, is measured from the LED to the 50% boundary location that is perpendicular to a longitudinal axis 668 of the LED module.

As seen in FIG. 30, the altered beam patterns 670 (see FIG. 28), which are generally elliptical, overlap, at least partially coincide with, or are in close proximity to each other. In this instance, the major axis 672 (or longest axis if the beam pattern is not elliptical) overlaps, at least partially coincides with, or is in close proximity to each other. Accordingly, tan β2 is about equal to (W/2)/D, i.e., ±30%, more preferably ±20%, and more preferably ±10%. Since the off-axis angle β2 for the LED in combination with the lens 666 in the upper LED module 660*a* is about half the luminous intensity of the on-axis luminous intensity and the off-axis angle β2 for the LED in the lower LED module 660*b* and the lens 666 is about half the luminous intensity of the on-axis luminous intensity, where the major axis 672 of the beam patterns 670 (FIG. 28) coincide, overlap, or are in close proximity with one another the illumination at this location should be substantially the same as the illumination directly on-axis for each respective LED and lens 666 combination. Accordingly, by providing the lens 666, the vertical spacing W can be increased while the LEDs offset the same distance D from the target plane. In other words, fewer LEDs can be used to provide a substantially uniform illumination on the translucent panel 14. It should be appreciated, however, the viewing angles need not be exactly to 50% luminous intensity.

FIGS. 31-36 depict an example of the lens 666. The lens 666 includes a refractive dome 680 that extends upwardly from a base 682. As most clearly seen in FIGS. 33-35, posts 684 depend downwardly from the base 682 to provide a locating feature for the lens with respect to the LED with which the lens cooperates. Each dome 680 includes a spherical outer surface 686 and an ellipsoidal inner surface 688. As is most clearly seen in FIG. 36, the base 682 defines an ellipsoid-shaped opening 692. The lens is thicker in a direction generally perpendicular to a major axis. Because of this design, there is a light converging effect to the thicker direction (perpendicular to the major axis 694).

Instead of using the lens particularly described in FIGS. 31-36, an alternative optic that can provide the desired beam spreading capabilities described in FIGS. 29 and 30 can also be utilized. For example, a reflective optic can be associated with each LED of the LED modules. The reflective optic can cooperate with the LED form beam patterns similar to the beam patterns 670 shown in FIG. 28. For example, the reflection optic could mount over the respective LED to redirect the light to form a desired beam pattern.

Figure 37:
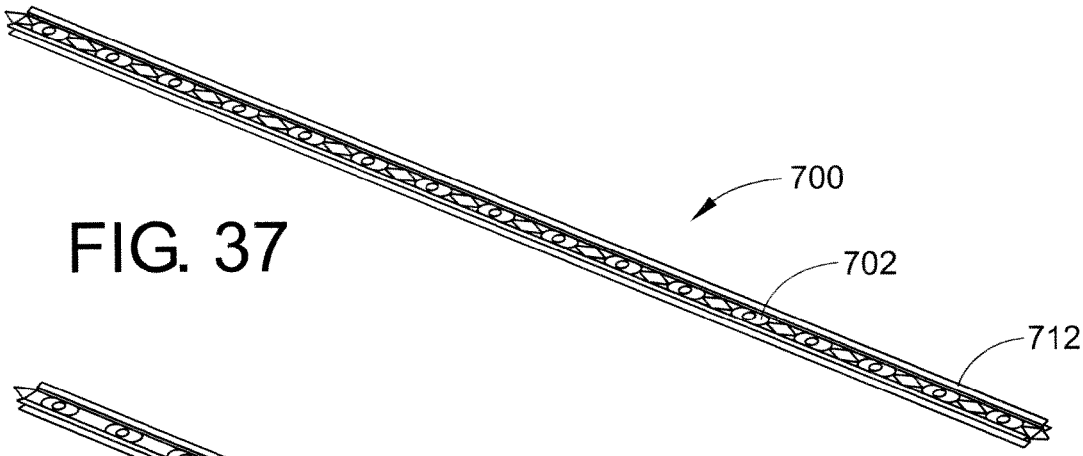
FIG. 37 is a perspective view of one side of a lighting system used to illuminate a cabinet sign.
Figure 38:
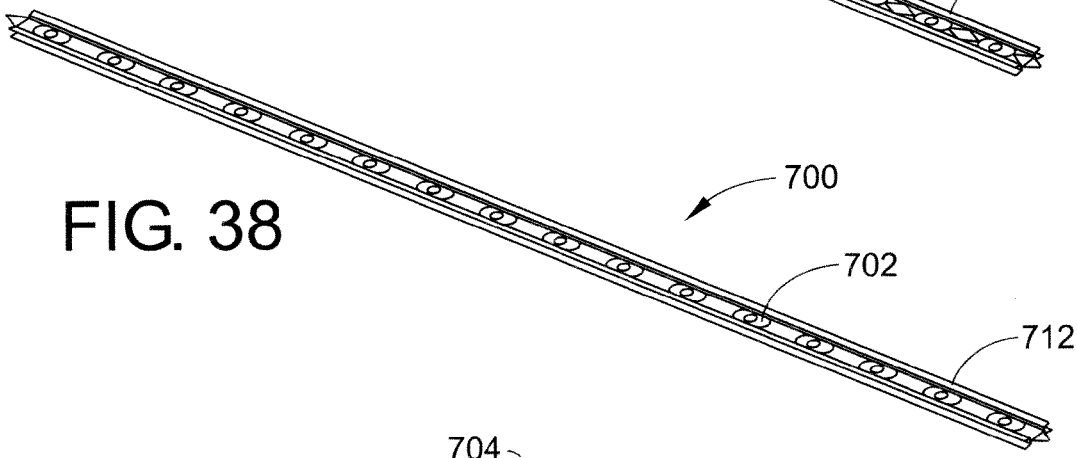
FIG. 38 is a perspective view of the other side of the lighting system depicted in FIG. 37.
Figure 39:
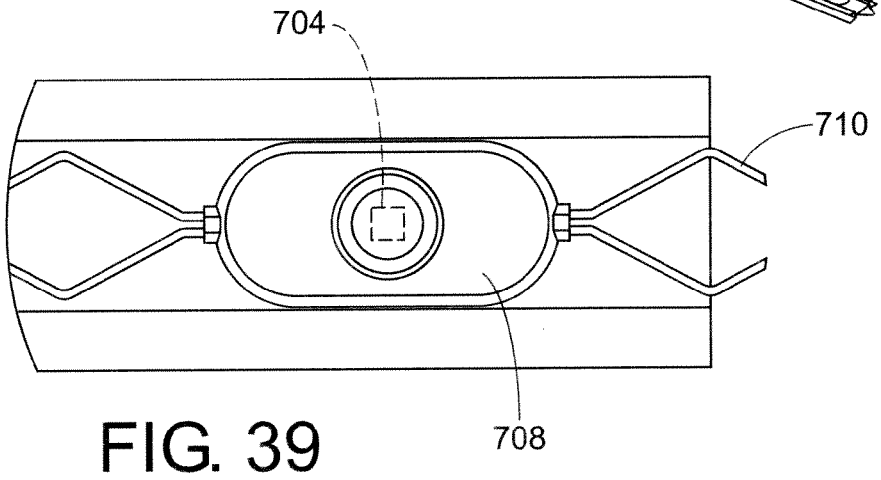
FIG. 39 is a plan view of a portion of the lighting system shown in FIG. 37.

FIG. 37 depicts an alternative embodiment of a lighting system that can be used to illuminate a box sign, such as the one shown in FIG. 1. The lighting system 700 includes a plurality of electrically interconnected modules 702 each including at least one LED 704 facing in a first direction to emit light toward the first direction and a second LED 706 facing in a second direction, which is opposite the first direction, to emit light in the second general direction. Similar to the embodiments described above, each LED module can also include at least one support having circuitry disposed on the support for providing electrical energy to the LED. Either a double-sided PCB or two single-sided PCBs faced back-to-back with one another can be provided in each module. Other supports, for example, flex circuits, can also be provided. A housing 708 is disposed over the at least one support for covering the circuitry.

Figure 40:
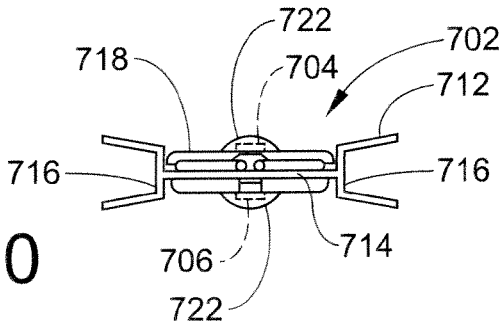
FIG. 40 is an end elevation view of the lighting system shown in FIG. 37.

The lighting system 700 further includes flexible electrical conductors 710 for electrically interconnecting the LED modules 702. The lighting system 700 also includes a rigid spine 712 connected with the modules 702. The rigid spine 712 can be more rigid than the at least one electrical conductor which allows the rigid spine to fix the modules 702 in relation to one another and along a longest dimension of the spine. Accordingly, the LEDs 704 on one side of the lighting system 700 and the LEDs 706 on another side of the lighting system 700 can be generally aligned along an axis, which is parallel to the longest dimension of the spine 712. With reference to FIG. 40, the spine can include openings (not visible) through a web section 714 to allow for the insertion of each module 702 into the opening to fix the module with respect to the spine 712. The spine 712 can also include channel sections 716 at opposite edges of the web section 714 to define an upper channel 718 and a lower channel 722 that each receives a portion of the LED module 702. As more clearly seen in FIG. 40, each LED 704 and 706 can cooperate with an optic 722 to further disperse the light from the respective LED.

By using the spine 712 shown in FIGS. 37-40, light from the LEDs 704 and 706 can be directed toward the translucent panels of the box sign without traveling through other translucent members, such as the tubular member 44 described above. The spines 712 can be formed in eight foot lengths and the LED modules 702 can be connected in parallel so that the lighting system can be easily cut to allow the lighting system to be installed in signs that are smaller than eight feet in each dimension.

A lighting system for illuminating cabinet signs has been described with reference to certain embodiments. Modifications and alterations will occur to those upon reading and understanding the detailed description. The invention is not limited to only those embodiments depicted in the preceding description. Instead, the invention is broadly defined by the appended claims and the equivalents thereof.

The invention claimed is:

1. A lighting system for illuminating a sign, the system comprising:

a plurality of electrically interconnected modules each including:

a support, circuitry on the support, at least two light emitting diodes ("LEDs") electrically connected to the circuitry, a first LED on a first surface of the support and facing in a first direction to emit light toward the first direction and a second LED on a second surface of the support and facing in a second direction, which is opposite the first direction, to emit light in a second general direction, a housing over the at least one support for covering the circuitry, and at least one electrical conductor electrically connecting the modules and a rigid spine connected with the modules, the spine being more rigid than the at least one electrical conductor for fixing the modules in relation to one another.

2. The system of claim 1, wherein the support comprises a double-sided printed circuit board ("PCB").

3. The system of claim 1, wherein the support comprises at least two single-sided PCBs.

4. The system of claim 1, wherein the spine includes a tubular member that surrounds the modules, the tubular member having a translucent section for allowing light from the LEDs to escape the tubular member, the translucent section being positioned with respect to the LEDs such that direct light from each LED escapes through a respective translucent section.

5. The system of claim 4, further comprising an end cap connected with the tubular member, the end cap being configured for connection with an associated sign housing.

6. The system of claim 5, wherein the end cap includes a recess that receives the tubular member, the recess and the tubular member have a non-circular configuration in cross section.

7. The system of claim 5, wherein the end cap includes a cavity surrounded by a base having a planar mounting surface, the cavity being large enough to cover a conventional fluorescent lamp socket.

8. The system of claim 4, wherein the tubular member includes a first section detachable from a second section to provide access to the modules.

9. The system of claim 8, wherein the first section pivots away from the second section about an axis parallel to a longest dimension of the tubular member.

10. The system of claim 1, wherein the spine includes projections that define a channel, the modules being received in the channel.

11. The system of claim 1, wherein the housing includes integrally formed mounting features having a generally planar surface for attaching the modules to an associated mounting beam disposed in an associated sign housing.

12. The system of claim 1, wherein each module includes a tongue at a first end and a slot at a second end, each tongue being configured to cooperate with a respective slot of an adjacent module for attaching adjacent modules together.

13. The system of claim 12, wherein each module includes electrical wires on each tongue and in each slot, the wires being electrically connected with the LEDs.

14. The system of claim 12, further comprising a plurality of end caps electrically interconnected via an electrical conductor, the end caps being configured to connect with either the tongue or the slot of each module, the end caps including electrical circuitry for electrically connecting the LEDs of the modules with the electrical conductor.

15. The system of claim 1, further comprising a plurality of links, each link mechanically, but not electrically, connecting a first module to an adjacent second module.

16. The system of claim 15, wherein each link includes a first connector and a set of second connectors, the first connector configured for attaching to the first module and each second connector configured for attaching to the second module to allow for different spacings between the first module and the adjacent second module.

17. The system of claim 1, wherein a first module pivotally connects to a second module.

18. The system of claim 17, wherein the modules are collapsible to a knocked down configuration.

19. A lighting system for illuminating a sign, the system comprising:

a plurality of electrically interconnected modules each including:

a support;

circuitry on the support;

at least two light emitting diodes ("LEDs") on the support and electrically connected to the circuitry, a first LED on a first surface of the support and emitting light in a first general direction and a second LED mounted on a second, opposite, surface of the support and emitting light in a second general direction, which is opposite the first direction;

a housing over the support for covering the circuitry; and a rigid tubular member receiving the housing and having a translucent section for allowing light from the LEDs to escape the tubular member.

20. The system of claim 19, further comprising an end cap connected with the tubular member, the end cap including a planar mounting surface normal to a longest dimension of the tubular member and fastener openings through the end cap at the planar mounting surface for receiving fasteners for attaching the end cap to an associated sign housing.

21. A lighting system comprising:

a plurality of electrically interconnected modules each including:

a support having a first generally planar surface and a second generally planar surface, the first surface being generally parallel to the second surface;

a first plurality of light emitting diodes ("LEDs") aligned generally along a first axis on the first surface facing a first direction;

a second plurality of LEDs aligned generally along a second axis on the second surface facing a second direction, which is opposite the first direction;

circuitry electrically interconnecting the LEDs; and a protective covering over the circuitry.

22. The system of claim 21, further comprising a beam spreading optic associated with each LED.

* * * * *